US009733584B2

(12) United States Patent
Masumoto et al.

(10) Patent No.: US 9,733,584 B2
(45) Date of Patent: Aug. 15, 2017

(54) TONER

(71) Applicant: CANON KABUSHIKI KAISHA, Tokyo (JP)

(72) Inventors: Akane Masumoto, Yokohama (JP); Katsuyuki Nonaka, Mishima (JP); Koji Abe, Numazu (JP); Toshihiko Katakura, Susono (JP); Tsuneyoshi Tominaga, Suntou-gun (JP); Shiro Kuroki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/089,218

(22) Filed: Apr. 1, 2016

(65) Prior Publication Data

US 2016/0299447 A1 Oct. 13, 2016

(30) Foreign Application Priority Data

Apr. 8, 2015 (JP) ..... 2015-079249

(51) Int. Cl.
*G03G 9/08* (2006.01)
*G03G 9/097* (2006.01)

(52) U.S. Cl.
CPC ..... *G03G 9/0825* (2013.01); *G03G 9/0819* (2013.01); *G03G 9/09725* (2013.01)

(58) Field of Classification Search
CPC ..... G03G 9/0825; G03G 9/09725
USPC ..... 430/108.3, 111.4
See application file for complete search history.

(56) References Cited

U.S. PATENT DOCUMENTS

| | | | |
|---|---|---|---|
| 6,458,502 | B1 | 10/2002 | Nakamura et al. |
| 6,500,593 | B2 | 12/2002 | Abe et al. |
| 6,569,589 | B2 | 5/2003 | Inaba et al. |
| 7,014,969 | B2 | 3/2006 | Yachi et al. |
| 7,300,737 | B2 | 11/2007 | Ayaki et al. |
| 7,459,253 | B2 | 12/2008 | Abe et al. |
| 7,704,661 | B2 | 4/2010 | Ikeda et al. |
| 8,053,156 | B2 | 11/2011 | Abe et al. |
| 8,084,178 | B2 | 12/2011 | Tosaka et al. |

(Continued)

FOREIGN PATENT DOCUMENTS

| | | |
|---|---|---|
| JP | H03-089361 | 4/1991 |
| JP | H09-179341 | 7/1997 |

OTHER PUBLICATIONS

U.S. Appl. No. 15/089,197, filed Apr. 1, 2016, Shiro Kuroki.

*Primary Examiner* — Mark A Chapman
(74) *Attorney, Agent, or Firm* — Fitzpatrick Cella Harper and Scinto

(57) ABSTRACT

Provided is a toner that is improved in transferability as compared to the related art and that keeps its effects through repeated use. In particular, provided is a toner suppressed in dependency on transfer current control. The toner includes a toner particle including a surface layer containing an organosilicon polymer and a resin having an ionic functional group, the organosilicon polymer having a partial structure represented by the following formula (1), the toner particle containing 5.0% or more of the partial structure represented by the formula (1) per 1.000 silicon atom contained in the organosilicon polymer, the resin having an ionic functional group having a pKa of 6.0 or more and 9.0 or less:

$$R^0—SiO_{3/2} \quad (1)$$

in the formula (1), $R^0$ represents an alkyl group having 1 or more and 6 or less carbon atoms, or a phenyl group.

8 Claims, 3 Drawing Sheets

(56) References Cited

U.S. PATENT DOCUMENTS

| | | | |
|---|---|---|---|
| 8,247,147 | B2 | 8/2012 | Abe et al. |
| 8,367,289 | B2 | 2/2013 | Isono et al. |
| 8,372,573 | B2 | 2/2013 | Ayaki et al. |
| 8,383,313 | B2 | 2/2013 | Ayaki et al. |
| 8,440,382 | B2 | 5/2013 | Isono et al. |
| 8,497,054 | B2 | 7/2013 | Sugiyama et al. |
| 8,551,680 | B2 | 10/2013 | Ayaki et al. |
| 8,574,801 | B2 | 11/2013 | Itabashi et al. |
| 8,609,312 | B2 | 12/2013 | Itabashi et al. |
| 8,652,737 | B2 | 2/2014 | Handa et al. |
| 8,778,581 | B2 | 7/2014 | Nonaka et al. |
| 8,822,120 | B2 | 9/2014 | Abe et al. |
| 8,828,639 | B2 | 9/2014 | Kamikura et al. |
| 9,029,056 | B2 | 5/2015 | Kenmoku et al. |
| 9,098,002 | B2 | 8/2015 | Kenmoku et al. |
| 9,098,003 | B2 | 8/2015 | Masumoto et al. |
| 2013/0065174 | A1 | 3/2013 | Itabashi et al. |
| 2015/0099220 | A1 | 4/2015 | Abe et al. |
| 2015/0099222 | A1 | 4/2015 | Terui et al. |
| 2015/0099224 | A1 | 4/2015 | Abe et al. |
| 2015/0248071 | A1 | 9/2015 | Katsura et al. |
| 2015/0248072 | A1 | 9/2015 | Katsuta et al. |
| 2015/0277251 | A1 | 10/2015 | Tominaga et al. |
| 2015/0286157 | A1 | 10/2015 | Masumoto et al. |
| 2015/0331344 | A1 | 11/2015 | Tominaga et al. |

TONER

BACKGROUND OF THE INVENTION

Field of the Invention

The present invention relates to a toner for developing an electrostatic charge image to be used in image forming methods, such as electrophotography and electrostatic printing.

Description of the Related Art

As an electrophotographic apparatus using a toner, there are given a laser printer and a copying machine. As a request from users with respect to electrophotographic apparatus, such as a copying machine and a printer, in recent years, there is a demand for the provision of downsizing, high durability for supporting high-speed printing, and an image of stable quality not depending on a usage environment (temperature, humidity).

In electrophotography, a toner charged positively or negatively is carried on a toner bearing member, an elestrostatic charge image-bearing member is charged to form a potential difference between an image portion and a non-image portion, and a toner on the toner bearing member is developed onto the image portion of the elestrostatic charge image-bearing member. The developed toner on the elestrostatic charge image-bearing member is subjected to a step (transfer step) of transferring the toner onto a transfer member, such as paper, or an intermediate transfer member and further transferring the toner onto a transfer member, and is fixed onto the transfer member with heat and pressure.

When a toner image formed on the elestrostatic charge image-bearing member by performing development is transferred onto the transfer member in the transfer step, a transfer residual toner may remain on the elestrostatic charge image-bearing member. In this case, it is necessary to clean the elestrostatic charge image-bearing member with a cleaning device to recover the transfer residual toner into a waste toner container. However, due to the presence of the cleaning device and the waste toner container, the apparatus is increased in size, and the increase becomes an obstacle for downsizing the apparatus. Therefore, there is a demand for further improvement of transferability in order to achieve downsizing of the apparatus.

Further, when a toner is transferred from the photosensitive member onto the transfer material, the amount of a toner that remains on the photosensitive member without being transferred onto the transfer member, that is, the transfer residual toner changes depending on the transfer current. In general, there is an optimum range of the transfer current in which the amount of the transfer residual toner becomes minimum. When the transfer current is lower than the optimum current range, a transfer electric field is small relative to attraction force between the toner and the photosensitive member, and hence the toner does not move and the amount of the transfer residual toner increases.

Meanwhile, when the transfer current is larger than the optimum current range, discharge occurs in a toner layer to rather decrease the transfer electric field, and hence the amount of the transfer residual toner is increased. Thus, it is desired that the transfer current be set to the lowest within the optimum current range.

However, the optimum current range changes also depending on the charge quantity of a toner. In particular, when printing is not performed for a long period of time under high humidity, a reduction in charge quantity, and a change in attraction force between the toner and the photosensitive member are liable to occur, and hence the optimum range of the transfer current is liable to change. In order to address this change, there is a method involving determining a transfer current with an environment detection device, such as a temperature and humidity sensor. However, there is a concern that various control devices may be complicated and increased in size. Therefore, there is a demand for a toner having satisfactory transferability within a wide transfer current range without a change in charge quantity even under high temperature and high humidity.

Hitherto, as a method of improving transferability, there has been given a method involving sticking an external additive to the surface of a toner particle to decrease physical adhesive force between a toner and a photosensitive member. However, when an image is printed on a large number of sheets, the external additive is embedded or detached to make a reducing effect on the adhesive force insufficient, and hence it is difficult to keep transferability. As a method of improving transferability, a method has been considered, which involves uniformly covering the surface of a toner particle with a silicon compound.

In Japanese Patent Application Laid-Open No. H03-089361, as a method of covering the surface of a toner particle with a silicon compound, there is a disclosure of a method of producing a polymerized toner by adding a silane coupling agent to a reaction system.

Further, in Japanese Patent Application Laid-Open No. H09-179341, there is a disclosure of a polymerized toner having on the surface thereof a coating film of a reaction product of a radical reactive organosilane compound.

SUMMARY OF THE INVENTION

Investigations made by the inventors of the present invention have found that, in the toner disclosed in Japanese Patent Application Laid-Open No. H03-089361, the precipitation amount of a silane compound onto the surface of the toner is insufficient, and the toner is susceptible to improvement in terms of transferability-improving effect. Further, it has been found that, in the toner disclosed in Japanese Patent Application Laid-Open No. H09-179341, its adhesive force changes due to moisture absorption under a high-temperature and high-humidity environment, and the transferability-improving effect is not sufficient, and hence the toner is susceptible to improvement.

The present invention is directed to providing a toner that is improved in transferability as compared to the related art and that keeps its effects through repeated use. In particular, the present invention is directed to providing a toner suppressed in dependency on transfer current control.

In order to achieve the above-mentioned objects, the inventors of the present invention have made extensive investigations, and as a result, have found the following toner.

That is, according to one aspect of the present invention, there is provided a toner including a toner particle including a surface layer derived from a resin particle, wherein:

the resin particle contains a resin having:

an ionic functional group, and an acid dissociation constant pKa of 6.0 or more and 9.0 or less, the surface layer further contains an organosilicon polymer;

the organosilicon polymer has a partial structure represented by the following formula (1);

$$R^0—SiO_{3/2} \quad (1)$$

in the formula (1), $R^0$ represents an alkyl group having 1 or more and 6 or less carbon atoms, or a phenyl group, in a $^{29}$Si-NMR measurement of a tetrahydrofuran-insoluble matter of the toner particle, the ratio of a peak area for the partial structure represented by the formula (1) to a total peak area for the organosilicon polymer is 5.0% or more.

Further features of the present invention will become apparent from the following description of exemplary embodiments with reference to the attached drawings.

DESCRIPTION OF THE EMBODIMENTS

Figure 1:
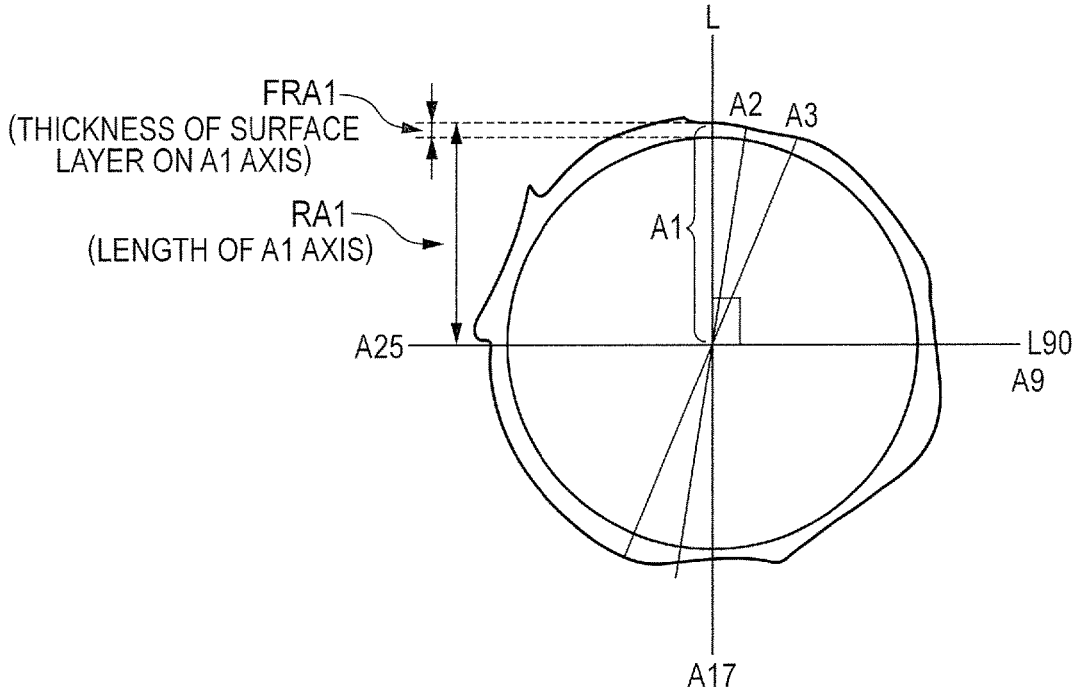
FIG. 1 is a conceptual diagram for defining the surface thickness of the surface of a toner containing an organosilicon compound.

Preferred embodiments of the present invention will now be described in detail in accordance with the accompanying drawings.

A toner of the present invention includes a toner particle including a surface layer derived from a resin particle containing a resin having an ionic functional group. The surface layer further contains an organosilicon polymer; and the organosilicon polymer has a partial structure represented by the following formula (1). In a $^{29}$Si-NMR measurement of a tetrahydrofuran-insoluble matter of the toner particle, the ratio of a peak area for the partial structure represented by the formula (1) to a total peak area for the organosilicon polymer is 5.0% or more, and the resin having an ionic functional group has a pKa of 6.0 or more and 9.0 or less. The toner of the present invention having the above-mentioned configuration has an excellent effect that a transfer current range (hereinafter expressed as "transfer latitude") in which transferability is satisfactory even under high temperature and high humidity is wide.

$$R^0—SiO_{3/2} \quad (1)$$

(In the formula (1), $R^0$ represents an alkyl group having 1 or more and 6 or less carbon atoms, or a phenyl group.)

The inventors of the present invention consider the reason that the toner of the present invention has high transferability within a wide transfer current range as described below.

The toner of the present invention contains the organosilicon polymer having a partial structure represented by $R^0—SiO_{3/2}$ (formula (1)) in the surface layer. In the partial structure represented by the formula (1), one of the four atomic valences of a Si atom is bonded to an organic group represented by $R^0$, and the other three atomic valences are bonded to O atoms. The O atoms each form a state in which both two atomic valences thereof are bonded to Si, that is, a siloxane bond (Si—O—Si). When Si atoms and O atoms in the organosilicon polymer as a whole are considered, the organosilicon polymer has three O atoms per two Si atoms, and hence the Si atoms and the O atoms are represented by $—SiO_{3/2}$. That is, the organosilicon polymer has a structure represented by the following formula (3).

Formula (3)

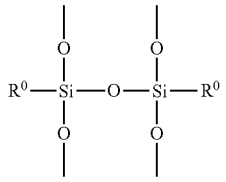

It is considered that the $—SiO_{3/2}$ structure of the organosilicon polymer has properties similar to those of silica ($SiO_2$) formed of a large number of siloxane structures. Thus, it is considered that the toner of the present invention creates a situation similar to that of the case where silica is added. Meanwhile, it is considered that, through incorporation of $R^0$, there is some action different from that of silica.

Further, the toner particle of the present invention also has a feature of including a surface layer derived from a resin particle containing a resin having an ionic functional group and having a pKa (acid dissociation constant) of 6.0 or more and 9.0 or less. It is considered that the incorporation of both the resin having an ionic functional group and the organosilicon polymer into the surface layer is an important factor for expressing a wide transfer latitude.

In a region of a low transfer current, a transfer electric field is small relative to attraction force between a toner and a photosensitive member, and hence a transfer residual toner is generated. It is considered that the transfer latitude is widened by decreasing the attraction force if possible. It is considered that one component of the attraction force is non-electrostatic adhesive force between the toner and the photosensitive member. It has been made clear that the non-electrostatic adhesive force is decreased when the organosilicon polymer and the resin having an ionic functional group are allowed to coexist. In general, a toner containing silica serving as an external additive on the surface of a toner particle has a reducing effect on adhesive force. Under a high-temperature and high-humidity environment, the adhesive force is increased due to the influence of water. Meanwhile, the organosilicon polymer of the present invention has a partial structure represented by $R^0—SiO_{3/2}$ and contains $R^0$ existing on the surface of a toner, and hence the density of oxygen having high compatibility with water is smaller than that of silica. Therefore, it is considered that there is a reducing effect on an increase in adhesive force by moisture absorption. Further, the resin having an ionic functional group and having a pKa of 6.0 or more and 9.0 or less has high hydrophobicity, and hence it is similarly considered that there is a higher reducing effect on adhesive force under a high-temperature and high-humidity environment as compared to that of related-art toners.

Meanwhile, in a region of a high transfer current, discharge occurs in a toner layer to generate a transfer residual toner. It is considered that, under a high-temperature and high-humidity environment, the charge quantity of a toner is low, and discharge is liable to occur even in a region of a low transfer current, and hence a transfer latitude becomes narrow. However, it is considered that the resin having an ionic functional group of the present invention has high hydrophobicity, and hence stable chargeability can be expressed without being influenced by water, with the result that a transfer latitude is widened. It is considered that, when the resin that expresses the stable chargeability exists in the surface layer, the effect is exhibited further strongly.

It is necessary that the toner particle according to the present invention contain 5.0 number % or more of the silicon atoms (0.050 or more silicon atom) of the partial structure represented by the formula (1) per 1.000 silicon atom contained in the organosilicon polymer according to the present invention. That is, in a $^{29}$Si-NMR measurement of a tetrahydrofuran-insoluble matter of the toner particle, the ratio of the peak area for the partial structure represented by the formula (1) to the total peak area for the organosilicon polymer is 5.0% or more. This means that 5.0% or more of the silicon of the organosilicon polymer contained in the toner particle correspond to the peak area for the partial structure represented by —$SiO_{3/2}$. A —$SiO_{3/2}$ skeleton is considered to be an element required for enhancing durability and optimizing a charge density, and it is interpreted that 5.0% or more of this structure needs to be incorporated. When the peak area for the partial structure is less than 5.0%, the effect on transferability is not exhibited easily through repeated use.

The —$SiO_{3/2}$ indicates, for example, that three of the four atomic valences of a Si atom are bonded to oxygen atoms, and the oxygen atoms are further bonded to other Si atoms. When one of those is SiOH, the partial structure of silicon thereof is represented by $R^0$—$SiO_{2/2}$—OH. This structure is similar to a disubstituted silicone resin typified by dimethyl silicone. It is considered that, when the peak area for the structure of —$SiO_{3/2}$ is less than 5.0%, a resinous property becomes dominant, and when the peak area for the structure of —$SiO_{3/2}$ is 5.0% or more, a hard property, such as that of silica, starts being expressed. That is assumed to be one factor for the satisfactory effect on transferability through repeated use.

Meanwhile, it is considered that, in the case where a structure, such as that of $SiO_2$, is dominant, the hard property becomes dominant, and there is an effect on transferability through repeated use. However, in this case, it is considered that the density of oxygen is high, and hence a reducing effect on adhesive force is not obtained easily under a high-humidity environment. The ratio of the peak area for the partial structure represented by the formula (1) to the total peak area for the organosilicon polymer is preferably 10.0% or more, more preferably 40.0% or more. It is considered that, when the ratio falls within the range, the structure of the organosilicon polymer is further strengthened, and the oxygen density is optimized to improve charge stability. Meanwhile, from the viewpoints of improvement of durability through stabilization of the structure and charging stability, it is preferred that the ratio of the peak area for the partial structure represented by the formula (1) to the total peak area for the organosilicon polymer be 100.0% or less. That is, it is most preferred that the ratio be approximated to 100.0% by various means. The ratio of the peak area for the partial structure represented by the formula (1) to the total peak area for the organosilicon polymer can be controlled by a reaction temperature during formation of the partial structure of the formula (1) and a pH during the reaction.

As described above, the toner of the present invention includes the surface layer derived from the resin particle containing the resin having an ionic functional group, the resin exhibiting stable chargeability even under a high-temperature and high-humidity environment, and further the surface layer contains the organosilicon polymer that reduces adhesive force and has high durability. The inventors of the present invention consider that, by virtue of the effects of the surface layer, a wide transfer latitude can be kept through repeated use.

Merely by causing the organosilicon polymer that exhibits a reducing effect on adhesive force and an improving effect on durability, and the resin having an ionic functional group that exhibits stable chargeability even under a high-temperature and high-humidity environment to each exist independently, the effects of the present invention are not exhibited sufficiently. One of the conditions for causing a wide transfer latitude to be exhibited through endurance (repeated use) is that both the organosilicon polymer and the resin having an ionic functional group exist in the surface layer in an appropriate ratio.

As a method of analyzing existence amounts of the organosilicon polymer and the resin having an ionic functional group, there are given various methods, such as NMR and TOF-SIMS. In the present invention, it has been made clear that there is a correlation between a measured value of X-ray photoelectron spectroscopic analysis and a transfer latitude, and hence X-ray photoelectron spectroscopic analysis is effective analysis means.

In order to cause a wide transfer latitude to be exhibited, it is preferred that, in X-ray photoelectron spectroscopic analysis of a surface of the toner particle of the present invention, a ratio of a silicon atom density dSi with respect to a total of 100.0 atomic % of a carbon atom density dC, an oxygen atom density do, and the silicon atom density dSi on the surface of the toner particle be 1.0 atomic % or more and 28.6 atomic % or less. The ratio is more preferably 4.0 atomic % or more and 26.0 atomic % or less. When the ratio falls within this range, the effects of the present invention can be satisfactorily exhibited.

Main atoms of the toner particle that are generally considered are carbon (C) and oxygen (O). In the present invention, when a silicon (Si) atom exists in the surface of the toner particle, there exists a portion in which an O atom is bonded to the Si atom. Then, —$SiO_{3/2}$ exists in an amount defined by the present invention. Thus, it is considered that, when the dSi falls within the above-mentioned range, the organosilicon polymer according to the present invention exists in the surface of the toner particle, with the result that the above-mentioned performance is improved. The silicon atom density dSi on the surface of the toner particle can be controlled by a content of the resin having an ionic functional group.

The resin having an ionic functional group in the present invention has a pKa of 6.0 or more and 9.0 or less. When the pKa (acid dissociation constant) of the resin having an ionic functional group is 6.0 or more and 9.0 or less, excellent charging performance is exhibited under a high-humidity environment. This is described below.

In general, a resin having a functional group, such as sulfonic acid or carboxylic acid, is often used as the resin having an ionic functional group. However, such resin adsorbs water easily, and the adsorption may decrease a charge quantity under high temperature and high humidity. However, when the pKa is 6.0 or more and 9.0 or less, the hygroscopicity of the resin can be reduced to suppress decrease in charge quantity under a high-humidity environment.

When the pKa is less than 6.0, a water adsorption amount is increased, and chargeability is decreased under high humidity. Further, when the pKa is more than 9.0, charging ability is low, and sufficient chargeability may not be expressed. The pKa of the resin having an ionic functional group is more preferably 7.0 or more and 8.5 or less.

A method of determining a pKa is described later; the pKa can be determined based on a neutralization titration result.

Any resin may be used as the resin having an ionic functional group as long as the above-mentioned pKa is satisfied. For example, a resin having a hydroxyl group bonded to an aromatic ring or a carboxy group bonded to an aromatic ring can set the pKa within the above-mentioned range. For example, a resin obtained by polymerizing vinylsalicylic acid, 1-vinyl phthalate, vinyl benzoate, and 1-vinylnatphthalene-2-carboxylic acid is preferred.

Further, it is more preferred that the resin having an ionic functional group comprises a polymer A having a monovalent group a represented by the following formula (2) as a molecular structure.

(2)

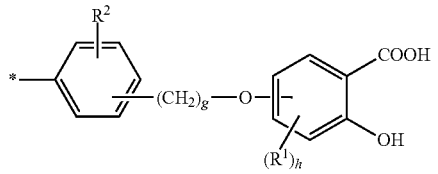

(In the formula (2), $R^1$ represents a hydroxy group, a carboxy group, an alkyl group having 1 or more and 18 or less carbon atoms, or an alkoxy group having 1 or more and 18 or less carbon atoms, $R^2$ represents a hydrogen atom, a hydroxy group, an alkyl group having 1 or more and 18 or less carbon atoms, or an alkoxy group having 1 or more and 18 or less carbon atoms, g represents an integer of 1 or more and 3 or less, h represents an integer of 0 or more and 3 or less, and when h represents 2 or 3, h $R^1$'s may be the same or different, and * represents a binding site in a main chain structure of the polymer A.)

Examples of the alkyl group represented by $R^1$ or $R^2$ include a methyl group, an ethyl group, a propyl group, an isopropyl group, a butyl group, an isobutyl group, a s-butyl group, and a t-butyl group. Examples of the alkoxy group include a methoxy group, an ethoxy group, and a propoxy group.

There is no particular limitation on a main chain structure of the polymer A as long as the monovalent group a represented by the formula (2) can be connected through the * portion. Examples of the main chain structure include a vinyl-based polymer, a polyester-based polymer, a polyamide-based polymer, a polyurethane-based polymer, and a polyether-based polymer. There is also given a hybrid-type polymer obtained by combining two or more kinds of the polymers. Of those, the vinyl-based polymer is preferred.

Further, it is preferred that the content of the monovalent group a represented by the formula (2) contained in the polymer A be 50 μmol/g or more and 1000 μmol/g or less. When the content is set to 50 μmol/g or more, satisfactory chargeability and durability can be exhibited. Further, when the content is set to 1,000 μmol/g or less, charge-up can be suppressed.

A content of the monovalent group a represented by the formula (2) in the polymer A can be determined by a method described below. First, the polymer A is titrated by a method described later to quantify an acid value of the polymer A, to thereby calculate an amount of a carboxy group derived from the monovalent group a represented by the formula (2) in the polymer A. Then, based on this calculated amount, a content (μmol/g) of the monovalent group a represented by the formula (2) in the polymer A can be calculated. When the polymer A has a carboxy group at a site except the monovalent group a represented by the formula (2), an acid value of a compound (for example, a polyester resin) immediately before an addition reaction of the monovalent group a represented by the formula (2) is measured in advance when the polymer A is produced. An addition amount of the monovalent group a represented by the formula (2) can be calculated based on a difference between the acid value measured in advance and the acid value of the polymer A after the addition reaction.

Further, a NMR measurement is performed to calculate a molar ratio of each component based on a value of integral derived from a characteristic chemical shift value of each monomer component, and based on this calculated molar ratio, a content (μmol/g) can be calculated.

As means for causing the organosilicon polymer and the resin having an ionic functional group to coexist, there are given various methods. However, in order to cause the effects of the present invention to be effectively exhibited, it is preferred that the resin having an ionic functional group exist on the outermost surface of a toner particle. Thus, it is preferred to employ a procedure involving producing a toner base particle containing the organosilicon polymer, and sticking the resin having an ionic functional group to the toner base particle from outside.

Specific examples of the procedure include: a method involving mixing a toner base particle and a resin particle containing the resin having an ionic functional group in a dry process, and sticking the resin particle to the toner base particle by mechanical treatment; and a method involving dispersing the toner base particle and the resin particle in an aqueous medium, and heating the dispersion liquid or adding an aggregating agent to the dispersion liquid. In the present invention, it is preferred that the resin particle be stuck to the surface of the toner base particle in the aqueous medium by heating for the following reason. In the aqueous medium, the resin particles are dispersed under a state of being charged, and hence the resin particles containing the resin having an ionic functional group can be uniformly stuck to the surface of the toner base particle without being aggregated. Further, irregularities on the surface of a toner particle can be increased in size, and hence the adhesive force of a toner can be further decreased.

Any method may be used as a production method for a resin particle. Resin particles produced by known methods, such as an emulsion polymerization method, a soap-free emulsion polymerization method, a phase inversion emulsification method, and a mechanical emulsification method, can be used. Of those production methods, the phase inversion emulsification method is preferred because an emulsifier and a dispersion stabilizer are not required, and a resin particle having a smaller particle diameter can be obtained easily.

In the phase inversion emulsification method, a resin having self-dispersibility or a resin capable of expressing self-dispersibility through neutralization is used. Herein, self-dispersibility in an aqueous medium is exhibited in a resin having a hydrophilic group in a molecule. Specifically, satisfactory self-dispersibility is exhibited in a resin having a polyether group or an ionic functional group.

For production of the resin particle of the present invention, a resin having an ionic functional group, which expresses self-emulsifiability through neutralization, is used. Specifically, a resin having an ionic functional group and having a pKa (acid dissociation constant) of 6.0 or more and 9.0 or less is used.

When the ionic functional group in the above-mentioned resin is neutralized, hydrophilicity is increased and self-dispersion in an aqueous medium is realized. When the resin is dissolved in an organic solvent, and a neutralizing agent is added to the solution, followed by mixing with an aqueous medium with stirring, the solution of the resin is subjected to phase inversion emulsification to generate fine particles. The organic solvent is removed by a method, such as heating or reduction in pressure, after the phase inversion emulsification. Thus, according to the phase inversion emulsification method, a stable aqueous dispersion of resin particles can be obtained substantially without using an emulsifier or a dispersion stabilizer.

In the present invention, it is preferred that, regarding the average particle diameter of the resin particle, a median diameter (D50) on a volume basis, which is determined by a particle size distribution measurement according to a laser scattering method, fall within the range of 5 nm or more and 200 nm or less. More preferably, the median diameter (D50) on a volume basis falls within the range of 20 nm or more and 130 nm or less. When the median diameter (D50) on a volume basis is 5 nm or more, sufficient durability is obtained. Further, when the median diameter (D50) on a volume basis is 200 nm or less, the resin particles can be stuck to the toner base particle more uniformly.

The surface layer in which the organosilicon polymer and the resin having an ionic functional group exist can be defined by observing a cross-section of the toner particle through use of a transmission electron microscope (TEM), and the detail thereof is described later. It is preferred that an average thickness Dav. of the surface layer be 5.0 nm or more. By virtue of the surface layer, an enlarging effect on a fogging latitude is obtained, and in addition, the toner particle can be protected from toner degradation factors through repeated use, such as rubbing and pressure. Thus, a wide transfer latitude can be kept further. The average thickness Dav. is more preferably 10.0 nm or more. Meanwhile, from the viewpoint of low-temperature fixability, the average thickness Dav. is preferably 300.0 nm or less, more preferably 150.0 nm or less.

Further, in the present invention, a ratio of the number of line segments in which the thickness of the surface layer is 2.5 nm or less (hereinafter sometimes referred to as "ratio of a thickness of 2.5 nm or less of the surface layer") is preferably 20.0% or less, more preferably 10.0% or less.

Further, when a ratio of the number of line segments in which the thickness of the surface layer of a toner containing the organosilicon polymer is 2.5 nm or less is 20.0% or less, a toner having excellent durability even in a wide environment and severe usage can be obtained. It is considered that, when the above-mentioned conditions are satisfied, high durability by the —$SiO_{3/2}$ structure is expressed strongly, and durable sustainability of a transfer latitude is significantly improved along with an action with the resin having an ionic functional group.

The average thickness Dav. of the surface layer and the ratio of a thickness of 2.5 nm or less of the surface layer can be controlled by a production method for a toner particle during formation of an organosilicon polymer, hydrolysis during formation of the organosilicon polymer, and a reaction temperature, a reaction time, a reaction solvent, and a pH during polymerization. The average thickness Dav. of the surface layer and the ratio of a thickness of 2.5 nm or less of the surface layer can also be controlled by the content of the organosilicon polymer. Further, the average thickness Dav. of the surface layer and the ratio of a thickness of 2.5 nm or less of the surface layer can be controlled by the number of addition parts of the resin having an ionic functional group, and the particle diameter of the resin particle.

In the present invention, it is more preferred that $R^0$ in the formula (1), which is a partial structure of the organosilicon polymer, represent a methyl group or an ethyl group. With this, the fogging latitude-enlarging effect in the present invention can be exhibited more strongly. The inventors of the present invention assume the reason for the foregoing as follows: the density of oxygen is in a state preferred for exhibiting the effect.

It is preferred that the organosilicon polymer to be used in the present invention be a polymer of an organosilicon compound having a structure represented by the following formula (4).

Formula (4)

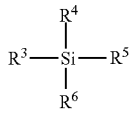

(In the formula (4), $R^3$ represents a saturated hydrocarbon group or an aryl group, and $R^4$, $R^5$, and $R^6$ each independently represent a halogen atom, a hydroxy group, an acetoxy group, or an alkoxy group.)

Through hydrolysis, addition polymerization, and condensation polymerization of the $R^4$, $R^5$, and $R^6$, a —Si—O—Si— structure is obtained easily, and conditions can be controlled easily. It is preferred that the $R^4$, $R^5$, and $R^6$ each represent an alkoxy group from the viewpoints of controllability of polymerization conditions and ease of formation of a siloxane structure. From the viewpoints of a precipitation property and a covering property of the organosilicon polymer with respect to the surface of the toner particle, it is more preferred that the $R^4$, $R^5$, and $R^6$ each represent a methoxy group or an ethoxy group. The hydrolysis, addition polymerization, and condensation polymerization of the $R^4$, $R^5$, and $R^6$ can be controlled based on a reaction temperature, a reaction time, a reaction solvent, and a pH.

Further, as the saturated hydrocarbon group of the $R^3$, there is given an alkyl group having 1 to 6 carbon atoms. The saturated hydrocarbon group is more preferably a methyl group, an ethyl group, or a butyl group, still more preferably a methyl group or an ethyl group. As the aryl group of the $R^3$, a phenyl group is preferred. For example, when an organosilicon compound in which the $R^3$ represents a methyl group or an ethyl group is used, $R^0$ in the formula (1) can be a methyl group or an ethyl group.

Specific examples of the organosilicon compound for producing the organosilicon polymer in the present invention include methyltrimethoxysilane, methyltriethoxysilane, methyltrichlorosilane, ethyltrimethoxysilane, ethyltriethoxysilane, ethyltrichlorosilane, ethyltriacetoxysilane, propyltrimethoxysilane, propyltriethoxysilane, propyltrichlorosilane, butyltrimethoxysilane, butyltriethoxysilane, butyltrichlorosilane, butylmethoxydichlorosilane, butylethoxydichlorosilane, hexyltrimethoxysilane, hexyltriethoxysilane, phenyltrimethoxysilane, and phenyltriethoxysilane. One kind of those organosilicon compounds may be used alone, or two or more kinds thereof may be used in combination.

In general, it is known that, in a sol-gel reaction, the bonding state of a siloxane bond to be generated varies depending on the acidity of a reaction medium. Specifically, when the medium is acidic, a hydrogen ion is electrophilically added to oxygen of one reaction group (for example, an alkoxy group (—OR group)). Then, an oxygen atom in a water molecule is coordinated to a silicon atom to become a hydrosilyl group through a substitution reaction. When water exists sufficiently, one $H^+$ attacks one oxygen of the reaction group (for example, an alkoxy group (—OR group)). Therefore, when the content of $H^+$ in the medium is small, the substitution reaction to a hydroxy group becomes slow. Thus, a polycondensation reaction occurs before all the reaction groups bonded to silane are subjected to hydrolysis, with the result that a one-dimensional linear polymer or a two-dimensional polymer is generated relatively easily.

Meanwhile, when the medium is alkaline, a hydroxide ion is added to silicon to form a five-coordinated intermediate. Therefore, all the reaction groups (for example, alkoxy groups (—OR groups)) are easily detached to be easily substituted by a silanol group. In particular, when a silicon compound having three or more reaction groups in the same silane is used, hydrolysis and polycondensation occur three-dimensionally, to thereby form an organosilicon polymer containing a large number of three-dimensional crosslinking bonds. Further, the reaction is finished within a short period of time.

Thus, in order to form an organosilicon polymer, it is preferred that the sol-gel reaction proceed under an alkaline state. When an organosilicon polymer is produced in an aqueous medium, specifically, it is preferred that the reaction proceed under the conditions of a pH of 8.0 or more, a reaction temperature of 90° C. or more, and a reaction time of 5 hours or more. With this, an organosilicon polymer having higher strength and being excellent in durability can be formed.

Next, a method of producing the toner particle of the present invention is described. The following resins can be used as the other additives within a range not influencing the effects of the present invention: homopolymers of styrene and substituted styrenes, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyester resin, a polyamide resin, an epoxy resin, a polyacrylic resin, rosin, modified rosin, a terpene resin, a phenol resin, an aliphatic or alicyclic hydrocarbon resin, and an aromatic petroleum resin. One kind of those resins may be used alone, or two or more kinds thereof may be used as a mixture.

Now, a specific method of producing the toner of the present invention is described, but the present invention is not limited thereto.

As a first production method, there is provided a method of obtaining a toner particle by a suspension polymerization method. More specifically, the method includes: a step (i) of forming a particle of a polymerizable monomer composition, which contains a polymerizable monomer, a colorant, and an organosilicon compound represented by the formula (4), in an aqueous medium; a step (ii) of polymerizing at least a part of the polymerizable monomer and the organosilicon compound contained in the particle of the polymerizable monomer composition to obtain a dispersion liquid of a polymer particle (toner base particle); and a step (iii) of adding a resin particle containing the resin having an ionic functional group to the dispersion liquid of the polymer particle.

The above-mentioned method is the most preferred production method because a layer containing the organosilicon polymer is formed on a surface, and the resin having an ionic functional group can be scattered uniformly on the outermost surface.

Further, in the step (ii) of the above-mentioned production method, the following method is also used, which involves taking out the organosilicon polymer as powder after the polymer has been formed into the surface layer and sticking the resin particle containing the resin having an ionic functional group to the surface of the powder in a dry process.

As a second production method, there is provided a method involving obtaining a toner base particle, and then forming a surface layer of an organosilicon polymer and the resin having an ionic functional group in an aqueous medium. The toner base particle may be obtained by melting and kneading a binder resin and a colorant, and pulverizing the resultant, or may be obtained by aggregating binder resin particles and colorant particles in an aqueous medium, and associating the aggregate. Alternatively, the toner base particle may be obtained by suspending and granulating an organic phase dispersion liquid, which is produced by dissolving a binder resin and a colorant in an organic solvent, in an aqueous medium, and thereafter removing the organic solvent.

As a third production method, there is provided a method involving: subjecting an organic phase dispersion liquid, which is produced by dissolving a binder resin, an organosilicon compound, and a colorant in an organic solvent, to suspension, granulation, and polymerization in an aqueous medium; removing the organic solvent to obtain a toner base particle; and then adding the resin particle containing the resin having an ionic functional group to the toner base particle. Also in this method, the organosilicon compound is polymerized in the vicinity of the surface of a toner particle under a state of being precipitated on the surface of the toner, and the resin having an ionic functional group exists on an outer side of the organosilicon polymer.

As a fourth production method, there is provided a method involving aggregating a binder resin particle, a colorant particle, an organosilicon compound-containing particle in a sol or gel state, and the resin particle containing the resin having an ionic functional group in an aqueous medium, and associating the aggregate, to thereby form a toner particle.

As a fifth production method, there is provided a method involving spraying a solvent containing the organosilicon compound and the resin particle containing the resin having an ionic functional group onto the surface of a toner base particle by a spray-dry method, and polymerizing or drying the surface by hot wind and cooling, to thereby form a surface layer containing the organosilicon polymer and the resin having an ionic functional group. The toner base particle may be obtained by melting and kneading a binder resin and a colorant, and pulverizing the resultant, or may be obtained by aggregating binder resin particles and colorant particles in an aqueous medium, and associating the aggregate. Alternatively, the toner base particle may be obtained by suspending and granulating an organic phase dispersion liquid, which is produced by dissolving a binder resin and a colorant in an organic solvent, in an aqueous medium, and thereafter removing the organic solvent.

The method involving sticking the resin particle containing the resin having an ionic functional group and having a pKa of 6.0 or more and 9.0 or less to the toner base particle in the aqueous medium to be used in the present invention is described.

In the step (sticking step) of sticking the resin particle containing the resin having an ionic functional group to the surface of the toner base particle in the aqueous medium, it is preferred that the pH (hydrogen ion concentration) of the aqueous medium be (pKa of the resin particle−2.0) or more.

The resin to be used in the present invention has a pKa (acid dissociation constant) of 6.0 or more and 9.0 or less, and hence the dissociation of an ionic functional group of the resin depends on the pH of the aqueous medium. When the pH of the aqueous medium is low, and few ionic functional groups dissociate, it is considered that there are many portions on the surface of the resin particle, which are not charged, and resin particles are easily brought into contact with each other and are stuck to the surface of a toner base particle under a state of being aggregated. In this sticking state, owing to the contact between toner particles or between a toner and a charging member, an aggregate of the resin particles is easily detached from the toner base particle, with result that charging stability is contrarily decreased. Further, the detached aggregate itself of the resin particles may cause contamination of members, and the contamination decreases durability. In the above-mentioned pH region, the aggregation of resin particles is suppressed, and the resin particles are uniformly and strongly stuck to a toner base particle, and hence excellent charging stability of the resin particles can be kept for a long period of time. Meanwhile, when the pH of the aqueous medium is less than (pKa of the resin−2.0), the dissociation of an ionic functional group of a resin hardly occurs, and resin particles are stuck to the surface of a toner base particle under a state of being aggregated. The pH of the aqueous medium is preferably at least the pKa of the resin. Further, it is preferred that the pH of the aqueous medium be (pKa of the resin+4.0) or less in order to suppress excessive dissociation of an ionic functional group.

As the sticking method for a resin particle, known procedures can be applied as long as the pH of the aqueous medium is adjusted to (pKa of the resin−2.0) or more. For example, a resin particle may be added to a dispersion liquid of a toner base particle and then buried in the toner base particle with mechanical force of impact, or the resin particle may be stuck to the toner base particle by heating the aqueous medium. Alternatively, the resin particle may be stuck to the toner base particle by adding an aggregating agent, or the above-mentioned procedures may be combined. In any case, it is preferred that the aqueous medium be stirred.

From the viewpoint of strongly sticking the resin particle to the toner base particle, a procedure for heating the aqueous medium to at least a glass transition temperature of the toner base particle is more preferred. Through setting of the aqueous medium to the above-mentioned temperature, the toner base particle is softened and is immobilized when the resin particle is brought into contact with the toner base particle.

Further, in the sticking step, it is preferred that a zeta potential of the toner base particle be larger by 10 mV or more than a zeta potential of the resin particle. When the zeta potential of the toner base particle is larger by 10 mV or more than the zeta potential of the resin particle, the resin particle is electrostatically stuck to the toner base particle. Therefore, sticking can be performed within a short period of time, and variation between toner particles can be suppressed.

The zeta potential of the toner base particle can be controlled through use of the above-mentioned dispersion stabilizer. Specifically, the zeta potential of the toner base particle can be controlled by the kind and amount of, and an adhesion method for, the dispersion stabilizer adhering to the surface of the toner base particle.

After the resin particle is stuck to the surface of the toner base particle, the resultant is subjected to filtration, washing, and drying by known methods to provide a toner particle. When an inorganic dispersion stabilizer is used, it is preferred that the dispersion stabilizer be dissolved in an acid or a base and then removed.

As the preferred aqueous medium in the present invention, there are given: water, alcohols, such as methanol, ethanol, and propanol, and mixed solvents thereof.

Preferred examples of the polymerizable monomer in the suspension polymerization method may include the following vinyl-based polymerizable monomers: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters, such as vinyl acetate, vinyl propionate, vinyl benzoate, vinyl butyrate, vinyl benzoate, and vinyl formate; vinyl ethers, such as vinyl methyl ether, vinyl ethyl ether, and vinyl isobutyl ether; and vinyl methyl ketone, vinyl hexyl ketone, and vinyl isopropyl ketone.

In addition, as a polymerization initiator to be used in the polymerization, the following polymerization initiators are given: azo-based or diazo-based polymerization initiators, such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators, such as benzoyl peroxide, methyl ethyl ketone peroxide, diisopropyl oxycarbonate, cumene hydroperoxide, 2,4-dichlorobenzoyl peroxide, and lauroyl peroxide. Any such polymerization initiator is preferably added in an amount of 0.5 mass % or more and 30.0 mass % or less with respect to the polymerizable monomer. One kind of those polymerization initiators may be used alone, or two or more kinds thereof may be used in combination.

Further, in order to control the molecular weight of the binder resin forming the toner particle, a chain transfer agent may be added in the polymerization. The addition amount thereof is preferably 0.001 mass % or more and 15.0 mass % or less of the polymerizable monomer.

Meanwhile, in order to control the molecular weight of the binder resin forming the toner particle, a crosslinking agent may be added in the polymerization. As a crosslinkable monomer, there are given: divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, a polyester-type diacrylate (MANDA manufactured by Nippon Kayaku Co., Ltd.), and monomers obtained by changing the above-mentioned acrylates to methacrylates.

As a polyfunctional crosslinkable monomer, there are given: pentaerythritol triacrylate, trimethylolethane triacrylate, trimethylolpropane triacrylate, tetramethylolmethane tetraacrylate, oligoester acrylate, and methacrylates thereof, 2,2-bis(4-methacryloxy polyethoxyphenyl)propane, diallyl phthalate, triallyl cyanurate, triallyl isocyanurate, triallyl trimellitate, and diallyl chlorendate. The addition amount thereof is preferably 0.001 mass % or more and 15.0 mass % or less with respect to the polymerizable monomer.

When the medium to be used in the suspension polymerization is an aqueous medium, the following may be used as a dispersion stabilizer for a particle of the polymerizable monomer composition: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. In addition, as an organic dispersant, there are given polyvinyl alcohol, gelatin, methylcellulose, methylhydroxypropylcellulose, ethylcellulose, carboxymethylcellulose sodium salt, and starch.

In addition, a commercially available nonionic, anionic, or cationic surfactant can also be utilized. Examples of the surfactant include sodium dodecyl sulfate, sodium tetradecyl sulfate, sodium pentadecyl sulfate, sodium octyl sulfate, sodium oleate, sodium laurate, and potassium stearate.

There is no particular limitation on the colorant to be used in the toner of the present invention, and the following known colorants may be used.

Used as a yellow pigment is yellow iron oxide, naples yellow, a condensed azo compound, such as naphthol yellow S, hansa yellow G, hansa yellow 10G, benzidine yellow G, benzidine yellow GR, a quinoline yellow lake, permanent yellow NCG, or tartrazine lake, an isoindoline compound, an anthraquinone compound, an azo metal complex, a methine compound, or an allyl amide compound. Specific examples thereof include C.I. Pigment Yellow 12, 13, 14, 15, 17, 62, 74, 83, 93, 94, 95, 109, 110, 111, 128, 129, 147, 155, 168, and 180.

As an orange pigment, there are given permanent orange GTR, pyrazolone orange, Vulcan orange, benzidine orange G, indanthrene brilliant orange RK, and indanthrene brilliant orange GK.

As a red pigment, there are given colcothar, condensed azo compounds, such as permanent red 4R, lithol red, pyrazolone red, watching red calcium salt, lake red C, lake red D, brilliant carmine 6B, brilliant carmine 3B, eosine lake, rhodamine lake B, and alizarin lake, a diketopyrrolopyrrol compound, anthraquinone, a quinacridone compound, a basic dye lake compound, a naphthol compound, a benzimidazolone compound, a thioindigo compound, and a perylene compound. Specific examples thereof include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

As a blue pigment, there are given alkali blue lake, Victoria blue lake, copper phthalocyanine compounds, such as phthalocyanine blue, metal-free phthalocyanine blue, a partial chloride of phthalocyanine blue, fast sky blue, and indanthrene blue BG, and derivatives thereof, an anthraquinone compound, and a basic dye lake compound. Specific examples thereof include C.I. Pigment Blue 1, 7, 15, 15:1, 15:2, 15:3, 15:4, 60, 62, and 66.

As a violet pigment, there are given fast violet B and methyl violet lake.

As a green pigment, there are given Pigment Green B, malachite green lake, and final yellow green G. As a white pigment, there are given zinc white, titanium oxide, antimony white, and zinc sulfide.

As a black pigment, there are given carbon black, aniline black, non-magnetic ferrite, magnetite, and a pigment toned to black with the above-mentioned yellow, red, and blue colorants. One kind of those colorants may be used alone, or two or more kinds thereof may be used as a mixture, and in the state of a solid solution.

The content of the colorant is preferably 3.0 parts by mass or more and 15.0 parts by mass or less with respect to 100 parts by mass of the binder resin or the polymerizable monomer.

A charge control agent except the resin having an ionic functional group and having a specific pKa may be used in the toner of the present invention during production thereof, and known charge control agents can be used. The addition amount of any such charge control agent is preferably 0.01 part by mass or more and 10.0 parts by mass or less with respect to 100 parts by mass of the binder resin or the polymerizable monomer.

In the toner of the present invention, various organic or inorganic fine powders may be externally added to the toner particle as necessary. It is preferred that any such organic or inorganic fine powder have a particle diameter of 1/10 or less of the weight-average particle diameter of the toner particle from the viewpoint of durability at time of addition to the toner particle. For example, the following fine powder is used as the organic or inorganic fine powder.

(1) Fluidity imparting agents: silica, alumina, titanium oxide, carbon black, and carbon fluoride.
(2) Abrasives: metal oxides (such as strontium titanate, cerium oxide, alumina, magnesium oxide, and chromium oxide), nitrides (such as silicon nitride), carbides (such as silicon carbide), and metal salts (such as calcium sulfate, barium sulfate, and calcium carbonate).
(3) Lubricants: fluorine-based resin powders (such as vinylidene fluoride and polytetrafluoroethylene) and fatty acid metal salts (such as zinc stearate and calcium stearate).
(4) Charge controllable particles: metal oxides (such as tin oxide, titanium oxide, zinc oxide, silica, and alumina) and carbon black.

The surface of the toner particle may be treated with the organic or inorganic fine powder in order to improve the flowability of the toner and to uniformize the charging of the toner particle. As a treatment agent for hydrophobic treatment of the organic or inorganic fine powder, there are given an unmodified silicone varnish, various modified silicone varnishes, an unmodified silicone oil, various modified silicone oils, a silane compound, a silane coupling agent, other organosilicon compounds, and an organotitanium compound. One kind of those treatment agents may be used alone, or two or more kinds thereof may be used in combination.

Various measurement methods related to the present invention are described below.

<NMR Measurement Method (Confirmation of Partial Structure Represented by Formula (1))>

The partial structure represented by the formula (1) in the organosilicon polymer contained in the toner particle was confirmed by the following solid NMR measurement. The measurement conditions and sample preparation method are as described below.

"Measurement Conditions"

Apparatus: JNM-EX400 manufactured by JEOL Ltd.
Probe: 6 mm CP/MAS probe
Measurement temperature: room temperature
Reference substance: polydimethylsilane (PDMS) (external reference: −34.0 ppm)
Measured nucleus: $^{29}$Si (resonance frequency: 79.30 MHz)
Pulse mode: CP/MAS
Pulse width: 6.4 μsec
Repetition time: ACQTM=25.6 msec, PD=15.0 sec
Data points: POINT=4,096, SAMPO=1,024
Contact time: 5 msec
Spectrum width: 40 kHz
Sample spinning rate: 6 kHz
Number of scans: 2,000 scans
Sample: 200 mg of a measurement sample (its preparation method is described below) is loaded into a sample tube having a diameter of 6 mm.

Preparation of a measurement sample: 10.0 g of toner particles are weighed and loaded into a cylindrical paper filter (No. 86R manufactured by Toyo Roshi Kaisha, Ltd.). The resultant is subjected to extraction with a Soxhlet extractor for 20 hours through use of 200 ml of tetrahydrofuran (THF) as a solvent. The residue in the cylindrical paper filter is dried in a vacuum at 40° C. for several hours, and the resultant is defined as a THF-insoluble matter of the toner particle for NMR measurement.

After the measurement, a plurality of silane components having different substituents and bonding groups of the toner particle are subjected to peak separation by curve fitting into the following Q1 structure, Q2 structure, Q3 structure, and Q4 structure, and mol % of each component is calculated from an area ratio of the peaks.

Software EXcalibur for Windows (trademark) version 4.2 (EX series) for JNM-EX400 manufactured by JEOL Ltd. was used for the curve fitting. Measurement data is opened by clicking "1D Pro" in menu icons.

Figure 2:
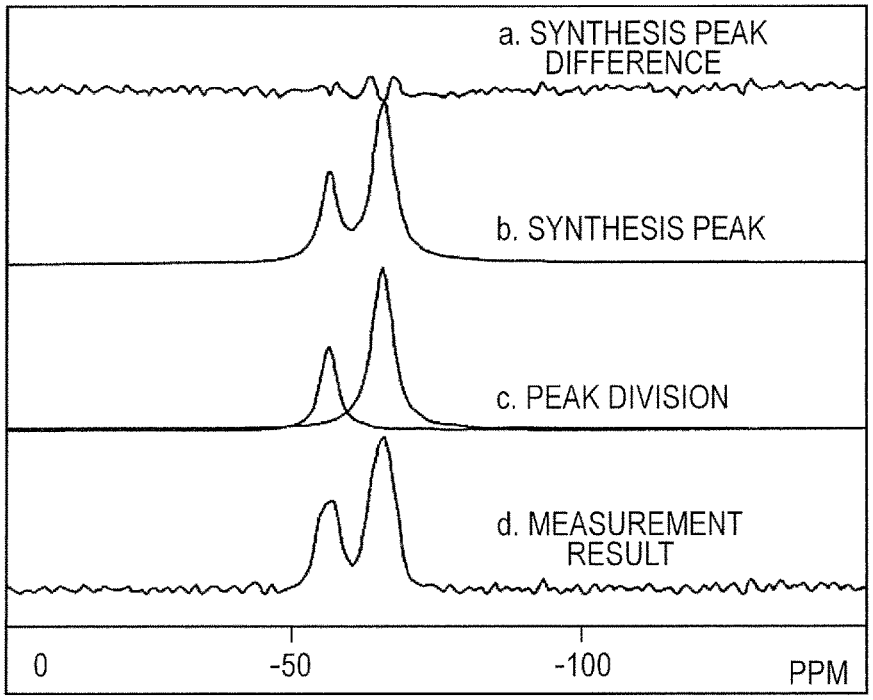
FIG. 2 is a graph for showing an NMR measurement example of an organosilicon compound in the present invention.

Next, "Curve fitting function" was selected from "Command" of a menu bar, and then curve fitting was performed. An example thereof is shown in FIG. 2. Peak separation was performed so that a peak of a synthesis peak difference (a) that was a difference between a synthesis peak (b) and a measurement result (d) became minimum.

An area for the Q1 structure, an area for the Q2 structure, an area for the Q3 structure, and an area for the Q4 structure are determined, and SQ1, SQ2, SQ3, and SQ4 are determined by the following formulae.

$Q1$ structure: $(R^7)(R^8)(R^9)SiO_{1/2}$ Formula (5)

$Q2$ structure: $(R^{10})(R^{11})Si(O_{1/2})_2$ Formula (6)

$Q3$ structure: $R^{12}Si(O_{1/2})_3$ Formula (7)

$Q4$ structure: $Si(O_{1/2})_4$ Formula (8)

Q1:

(5)

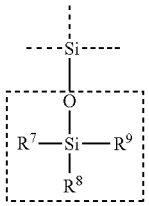

Q2:

(6)

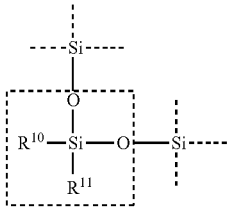

Q3:

(7)

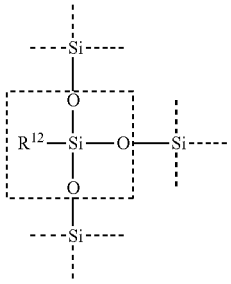

Q4:

(8)

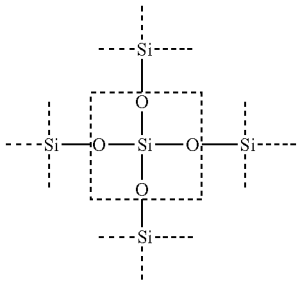

(In the formulae (5), (6), and (7), $R^7$, $R^8$, $R^9$, $R^{10}$, $R^{11}$, and $R^{12}$ each represent an organic group bonded to silicon, a halogen atom, a hydroxy group, or an alkoxy group.)

In the present invention, a silane monomer is identified by a chemical shift value, and in the $^{29}$Si-NMR measurement of the toner particle, from a total peak area, a total of the area for the Q1 structure, the area for the Q2 structure, the area for the Q3 structure, and the area for the Q4 structure is defined as a total peak area for the organosilicon polymer.

$$SQ1+SQ2+SQ3+SQ4=1.000$$

$SQ1$={area for $Q1$ structure/(area for $Q1$ structure+area for $Q2$ structure+area for $Q3$ structure+area for $Q4$ structure)}

$SQ2$={area for $Q2$ structure/(area for $Q1$ structure+area for $Q2$ structure+area for $Q3$ structure+area for $Q4$ structure)}

$SQ3$={area for $Q3$ structure/(area for $Q1$ structure+area for $Q2$ structure+area for $Q3$ structure+area for $Q4$ structure)}

$SQ4$={area for $Q4$ structure/(area for $Q1$ structure+area for $Q2$ structure+area for $Q3$ structure+area for $Q4$ structure)}

In the present invention, the ratio of the peak area for the partial structure represented by the following formula (1) to the total peak area for the organosilicon polymer is 5.0% or more. That is, in this measurement method, the value indicating the $—SiO_{3/2}$ structure is the SQ3. This value is 0.050 or more.

$$R^0—SiO_{2/3} \quad (1)$$

Chemical shift values of silicon in the Q1 structure, the Q2 structure, the Q3 structure, and the Q4 structure are shown below.

An example of the Q1 structure ($R^7$═$R^8$═—$OC_2H_5$, $R^9$═—$CH_3$): −47 ppm

An example of the Q2 structure ($R^{10}$═—$OC_2H_5$, $R^{11}$═—$CH_3$): −56 ppm

An example of the Q3 structure ($R^{12}$═—$CH_3$): −65 ppm

Further, a chemical shift value of silicon when the Q4 structure is present is shown below.

Q4 structure: −108 ppm

[Confirmation Method for Partial Structure Represented by Formula (1)]

The presence/absence of an organic group represented by $R^0$ in the formula (1) is confirmed by $^{13}$C-NMR. Further, the detailed structure of the formula (1) is confirmed by $^1$H-NMR, $^{13}$C-NMR, and $^{29}$Si-NMR. An apparatus and measurement conditions used are as described below.

"Measurement Conditions"

Apparatus: AVANCE III 500 manufactured by Bruker Corporation

Probe: 4 mm MAS BB/1H

Measurement temperature: room temperature

Sample spinning rate: 6 kHz

Sample: 150 mg of a measurement sample (THF-insoluble matter of the toner particle for the NMR measurement) is loaded into a sample tube having a diameter of 4 mm.

The presence/absence of the organic group represented by $R^0$ in the formula (1) was confirmed by the method. The structure represented by the formula (1) is "present" when a signal is confirmed.

"$^{13}$C-NMR (Solid) Measurement Conditions"

Measured nucleus frequency: 125.77 MHz

Reference substance: glycine (external standard: 176.03 ppm)

Measurement width: 37.88 kHz

Measurement method: CP/MAS

Contact time: 1.75 ms

Repetition time: 4 s

Number of scans: 2,048 scans

LB value: 50 Hz

In the present invention, when the organic fine powder or the inorganic fine powder is externally added to the toner, toner particles are obtained through the removal of the organic fine powder or the inorganic fine powder by the following method.

160 g of sucrose (manufactured by Kishida Chemical Co., Ltd.) is added to 100 mL of ion-exchanged water and dissolved through use of a water bath, to thereby prepare a sucrose concentrated solution. 31 g of the sucrose concentrated solution and 6 mL of Contaminon N (10 mass % aqueous solution of a neutral detergent for washing a precision measuring device formed of a nonionic surfactant, an anionic surfactant, and an organic builder and having a pH of 7, manufactured by Wako Pure Chemical Industries, Ltd.) are loaded into a centrifugation tube, to thereby produce a dispersion liquid. 1.0 g of the toner is added to the dispersion liquid, and a toner lump is broken with a spatula or the like.

The centrifugation tube is shaken with a shaker at 350 strokes per min (spm) for 20 minutes. After the shaking, the solution is transferred into a glass tube for a swing rotor (50 mL) and subjected to centrifugation with a centrifugal separator under the conditions of 3,500 rpm and 30 minutes. With this operation, the solution is separated into toner particle and external additives detached from the toner particle. It is confirmed visually that the toner and the aqueous solution have been sufficiently separated, and the toner separated into the uppermost layer is collected with a spatula or the like. The collected toner is filtered with a vacuum filter and then dried with a drier for 1 hour or more, to thereby provide toner particles. A required amount is obtained by performing this operation a plurality of times.

<Method of Measuring Average Thickness Dav. Of Surface Layer of Toner Particle, and Ratio of Thickness of 2.5 nm or Less of Surface Layer, to be Measured by Observation of Cross-Section of Toner Particle Through Use of Transmission Electron Microscope (TEM)>

In the present invention, a cross-section of a toner particle is observed by the following method.

A specific method of observing a cross-section of a toner particle is as described below. Toner particles are sufficiently dispersed in an epoxy resin that is curable at normal temperature, and then the resultant is cured under an atmosphere of 40° C. for 2 days. A flake-like sample is cut out from the obtained cured product through use of a microtome provided with diamond teeth. The sample is magnified at a magnification of from 10,000 times to 100,000 times with a transmission electron microscope (TEM) (electron microscope Tecnai TF20XT manufactured by FEI Company), and cross-sections of the toner particles are observed.

In the present invention, the cross-sections are confirmed through use of: a difference in atomic weight between atoms in a resin and an organosilicon compound to be used; and the fact that contrast is increased when an atomic weight is large. Further, in order to provide contrast between materials, a ruthenium tetroxide staining method and an osmium tetroxide staining method are used.

A particle used in the measurement is determined as described below. A circle-equivalent diameter Dtem of a toner particle is determined based on its cross-section obtained from the TEM image, and when a value thereof falls within a range of ±10% of the weight-average particle diameter of the toner particle determined by a method described later, that particle is defined as the particle used in the measurement.

A light field image of a cross-section of a toner particle is acquired at an acceleration voltage of 200 kV through use of an electron microscope Tecnai TF20XT manufactured by FEI Company as described above. Next, an EF mapping image of a Si—K end (99 eV) is acquired by a Three Window method through use of an EELS detector GIF Tridiem manufactured by Gatan, Inc. to confirm that an organosilicon polymer exists in a surface layer.

Then, a cross-section of one toner particle whose circle-equivalent diameter Dtem falls within a range of ±10% of the weight-average particle diameter of the toner particle is equally divided into 16 sections, with an intersection between a long axis L that is the maximum diameter of the cross-section of the toner particle and an axis L90 that passes through a midpoint of the long axis L and is perpendicular thereto being a center (see FIG. 1). That is, 16 straight lines that cross the cross-section are drawn so as to pass through the midpoint of the long axis L and to form an equal crossing angle at the midpoint (crossing angle: 11.25°), to thereby form 32 line segments from the midpoint to a surface of the toner particle. Then, the line segments (division axes) from the center to the surface layer of the toner particle are each defined as An (n=1 to 32), the length of each of the line segments (division axes) is defined as RAn, and the thickness of the surface layer on the line segment An is defined as FRAn (n=1 to 32).

An average thickness Dav. of the surface layer containing the organosilicon polymer in 32 portions on the line segments (division axes) is determined through use of the above-mentioned parameters. Further, a ratio of the number of the line segments out of the 32 line segments on each of which the thickness of the surface layer containing the organosilicon polymer is 2.5 nm or less is determined.

In the present invention, for averaging, an average value per toner particle was calculated by measuring ten toner particles.

"Circle-Equivalent Diameter (Dtem) Determined Based on Cross-Section of Toner Particle Obtained from Transmission Electron Microscope (TEM) Image"

A circle-equivalent diameter (Dtem) determined based on a cross-section of a toner particle obtained from a TEM image is determined by the following method. First, regarding one toner particle, a circle-equivalent diameter Dtem determined based on a cross-section of the toner particle obtained from a TEM image is determined by the following expression.

$$[\text{Circle-equivalent diameter determined based on cross-section of toner particle obtained from TEM image } (Dtem)] = (RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

Circle-equivalent diameters of the ten toner particles are determined, and an average value per toner particle is calculated as a circle-equivalent diameter (Dtem) determined based on a cross-section of a toner particle.

[Measurement of Average Thickness (Dav.) of Surface Layer of Toner Particle]

An average thickness (Dav.) of a surface layer of a toner particle is determined by the following method. First, an average thickness $D_{(n)}$ of the surface layer of one toner particle is determined by the following method.

$$D_{(n)} = (\text{Total of thicknesses of surface layer in 32 portions on division axes})/32 = (FRA1+FRA2+FRA3+FRA4+FRA5+FRA6+FRA7+FRA8+FRA9+FRA10+FRA11+FRA12+FRA13+FRA14+FRA15+FRA16+FRA17+FRA18+FRA19+FRA20+FRA21+FRA22+FRA23+FRA24+FRA25+FRA26+FRA27+FRA28+FRA29+FRA30+FRA31+FRA32)/32$$

In order to attain averaging, the average thickness (Dav.) of the surface layer of the toner particle is obtained by determining the average thickness $D_{(n)}$ (n=1 to 10) of the surface layer of the toner particle as to ten toner particles, and calculating the average value thereof per toner particle.

$$Dav. = \{D_{(1)}+D_{(2)}+D_{(3)}+D_{(4)}+D_{(5)}+D_{(6)}+D_{(7)}+D_{(8)}+D_{(9)}+D_{(10)}\}/10$$

[Measurement of Ratio of Thickness of 2.5 nm or Less of Surface Layer]

$$[\text{Ratio in which thickness } (FRAn) \text{ of surface layer is 2.5 nm or less}] = [\{\text{Number of division axes in which thickness } (FRAn) \text{ of surface layer is 2.5 nm or less}\}/32] \times 100$$

This calculation was performed on ten toner particles, and an average value of the obtained ten ratios in which the thicknesses (FRAn) of surface layers were 2.5 nm or less was determined as a ratio in which the thickness (FRAn) of the surface layer of the toner particle was 2.5 nm or less.

<Measurement Methods for Weight-Average Particle Diameter (D4) and Number-Average Particle Diameter (D1) of Toner Particle>

The weight-average particle diameter (D4) and number-average particle diameter (D1) of the toner particle are calculated as described below. A precision particle size distribution measuring apparatus based on a pore electrical resistance method provided with a 100 μm aperture tube "Coulter Counter Multisizer 3" (trademark, manufactured by Beckman Coulter, Inc.) is used as a measuring apparatus. Dedicated software included thereto "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1 mass %, for example, "ISOTON II" (manufactured by Beckman Coulter, Inc.) can be used in the measurement.

The dedicated software was set as described below prior to the measurement and the analysis.

In the "change standard measurement method (SOMME)" screen of the dedicated software, the total count number of a control mode is set to 50,000 particles, the number of times of measurement is set to 1, and a value obtained by using "standard particles having a particle diameter of 10.0 μm" (manufactured by Beckman Coulter, Inc.) is set as a Kd value. A threshold and a noise level are automatically set by pressing a "threshold/noise level measurement button". In addition, a current is set to 1,600 μA, a gain is set to 2, and an electrolyte solution is set to ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of from 2 μm to 60 μm.

A specific measurement method is as described below.

(1) About 200 ml of the electrolyte aqueous solution is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the dedicated software.

(2) About 30 ml of the electrolyte aqueous solution is charged into a 100-milliliter flat-bottom beaker made of glass. About 0.3 ml of a diluted solution prepared by diluting "Contaminon N" (10 mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three parts by mass fold is added as a dispersant to the electrolyte aqueous solution.

(3) An ultrasonic dispersing unit "Ultrasonic Dispension System Tetra 150" (manufactured by Nikkaki Bios Co., Ltd.) in which two oscillators each having an oscillatory frequency of 50 kHz are built so as to be out of phase by 180° and which has an electrical output of 120 W is prepared. 3.3 L of ion-exchanged water is charged into the water tank of the ultrasonic dispersing unit. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of the toner particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the concentration of the toner particles to be measured is adjusted to 5%. Then, measurement is performed until the particle diameters of 50,000 particles are measured.

(7) The measurement data is analyzed with the dedicated software included with the apparatus, and the weight-average particle diameter (D4) and the number-average particle diameter (D1) are calculated. An "average diameter" on the "analysis/volume statistics (arithmetic average)" screen of the dedicated software when the dedicated software is set to show a graph in a vol % unit is the weight-average particle diameter (D4). In addition, an "average diameter" on the "analysis/number statistics (arithmetic average)" screen of the dedicated software when the dedicated software is set to show a graph in a number % unit is the number-average particle diameter (D1).

<Density of Silicon Atom (Atomic %) Existing in Surface of Toner Particle>

The density of a silicon atom [dSi] (atomic %), the density of a carbon atom [dC] (atomic %), and the density of an oxygen atom [dO] (atomic %), the atoms existing in the surface of the toner particle, are calculated by performing surface composition analysis through use of X-ray photoelectron spectroscopic analysis (ESCA: Electron Spectroscopy for Chemical Analysis).

In the present invention, an apparatus and measurement conditions for ESCA are as described below.

Used apparatus: Quantum 2000 manufactured by ULVAC-PHI, Inc.

X-ray photoelectron spectrometer measurement conditions:

X-ray source: Al Kα

X-ray: 100 μm, 25 W, 15 kV

Raster: 300 μm×200 μm

Pass energy: 58.70 eV

Step size: 0.125 eV

Neutralization electron gun: 20 μA, 1 V

Ar ion gun: 7 mA, 10 V

Number of sweeps: Si: 15 sweeps, C: 10 sweeps, O: 10 sweeps

In the present invention, the density of a silicon atom [dSi], the density of a carbon atom [dC], and the density of an oxygen atom [dO] (each represented in an atomic % unit), the atoms existing in the surface of the toner particle, were calculated through use of a relative sensitivity factor provided by PHI, Inc. based on the measured peak intensity of each element.

Then, a ratio (atomic %) of the silicon atom density dSi to a total (dC+dO+dSi) of the carbon atom density dC, the oxygen atom density do, and the silicon atom density dSi of 100.0 atomic % in the surface layer of the toner particle was determined.

<Glass Transition Temperatures (Tg)>

The glass transition temperatures (Tg) of the toner base particles and the resin particles are measured with a differential scanning calorimeter (DSC) M-DSC (trade name: Q2000, manufactured by TA Instruments) by the following procedure. 3 mg of a sample to be subjected to the measurement is precisely weighed. The sample is loaded into an aluminum pan, and is subjected to the measurement under normal temperature and normal humidity by using an empty aluminum pan as a reference at a measurement temperature in the range of from 20° C. to 200° C. and a rate of temperature increase of 1° C./min. At this time, the measurement is performed at a modulation amplitude of ±0.5° C. and a frequency of 1/min. The glass transition temperature (Tg: ° C.) is calculated from a reversing heat flow curve to be obtained. A center value between the points of intersection of baselines before and after heat absorption, and a tangent to a curve based on the heat absorption is determined as the Tg (° C.).

<Acid Value>

The acid value is the number of milligrams of potassium hydroxide required for neutralizing an acid contained in 1 g of a sample. The acid value in the present invention is measured in accordance with JIS K 0070-1992, specifically, the following procedure.

Titration is performed through use of a 0.1 mol/l potassium hydroxide-ethyl alcohol solution (manufactured by Kishida Chemical Co., Ltd.). A factor of the potassium hydroxide-ethyl alcohol solution can be determined through use of a potentiometric titrator (potentiometric titration measurement apparatus AT-510 manufactured by Kyoto Electronics Manufacturing Co., Ltd.). 100 ml of 0.1 mol/l hydrochloric acid is loaded into a 250-milliliter tall beaker and titrated with the potassium hydroxide-ethyl alcohol solution, and an acid value is determined based on the amount of the potassium hydroxide-ethyl alcohol solution required for neutralization. Hydrochloric acid prepared in accordance with JIS K 8001-1998 is used as the 0.1 mol/l hydrochloric acid.

Measurement conditions in the acid value measurement are described below.

Titration: potentiometric titrator AT-510 (manufactured by Kyoto Electronics Manufacturing Co., Ltd.)

Electrode: combination glass electrode, double junction type (manufactured by Kyoto Electronics Manufacturing Co., Ltd.)

Control software for titrator: AT-WIN

Software for analyzing titration: Tview

Titration parameters and control parameters in titration are as described below.

Titration Parameters

Titr. mode: Blank Titration

Titr. form: Full Titration

Max. Volume: 20 ml
Wait Time before Titration: 30 s
Titration Direction: Auto
Control Parameters
End point judgment potential: 30 dE
End point judgment potential value: 50 dE/dmL
End point detection judgment: Not set
Ctl. speed mode: Std
Gain: 1
Data samp. Pot.: 4 mV
Data samp. Vol.: 0.1 ml Main Test 0.100 g of a measurement sample is precisely weighed into a 250-milliliter tall beaker, and 150 ml of a mixed solution of toluene and ethanol (3:1) is added to the beaker to dissolve the sample over 1 hour. The solution is titrated with the potassium hydroxide-ethyl alcohol solution through use of the above-mentioned potentiometric titrator.

Blank Test

The same titration as that in the above-mentioned operation is performed except that the sample is not used (that is, only the mixed solution of toluene and ethanol (3:1) is used).

An acid value is calculated by substituting the result thus obtained into the following expression.

$$A=[(C-B)\times f\times 5.611]/S$$

(In the expression, A represents the acid value (mgKOH/g), B represents the addition amount (ml) of the potassium hydroxide-ethyl alcohol solution in the blank test, C represents the addition amount (ml) of the potassium hydroxide-ethyl alcohol solution in the main test, f represents the factor of the potassium hydroxide solution, and S represents the sample (g).)

<pKa>

0.100 g of a measurement sample is precisely weighed into a 250-milliliter tall beaker, and 150 ml of THF is added to the beaker to dissolve the sample over 30 minutes. A pH electrode is placed in this solution, and a pH of the THF solution of the sample is read. After that, a 0.1 mol/l potassium hydroxide-ethyl alcohol solution (manufactured by Kishida Chemical Co., Ltd.) is added by 10 μl to the solution, and a pH is read and titration is performed for every addition. The 0.1 mol/l potassium hydroxide-ethyl alcohol solution is added until the pH reaches 10 or more and does not change even when 30 μl of the potassium hydroxide-ethyl alcohol solution is added. A pH is plotted against the addition amount of the 0.1 mol/l potassium hydroxide-ethyl alcohol solution based on the obtained result. Thus, a titration curve is obtained. A point at which the tilt of a pH change becomes maximum in the obtained titration curve is defined as a neutralization point. A pKa is determined as described below. A pH at a half of the amount of the 0.1 mol/l potassium hydroxide-ethyl alcohol solution required up to the neutralization point is read from the titration curve, and a value of the read pH is defined as a pKa.

<NMR (Confirmation of Content of Monovalent Group a Contained in Polymer A)>

A content of a monovalent group a contained in a polymer A is measured through use of nuclear magnetic resonance spectrometric analysis ($^1$H-NMR) [400 MHz, $CDCl_3$, room temperature (25° C.)].

Measurement apparatus: FT-NMR apparatus JNM-EX400 (manufactured by JEOL Ltd.)
Measurement frequency: 400 MHz
Pulse condition: 5.0 μs
Frequency range: 10,500 Hz
Number of scans: 64 scans A molar ratio of each monomer component is determined based on a value of integral of the obtained spectrum, and based on the molar ratio, the mol % of the monovalent group a contained in the polymer A is calculated.

<Median Diameter (D50) on Volume Basis of Resin Particles>

A median diameter (D50) on a volume basis of resin particles is calculated by measuring a particle diameter by dynamic light scattering (DLS) through use of Zetasizer Nano-ZS (manufactured by Malvern Instruments Ltd.).

First, a power source of an apparatus is turned on and kept in this state for 30 minutes until a laser becomes stable. Then, Zetasizer software is activated.

Manual is selected from a Measure menu, and the detail of the measurement is input as described below.

Measurement mode: particle diameter
Material: Polystyrene latex (RI: 1.59, Absorption: 0.01)
Dispersant: Water (Temperature: 25° C., Viscosity: 0.8872 cP, RI: 1.330)
Temperature: 25.0° C.
Cell: Clear disposable zeta cell
Measurement duration: Automatic A sample is prepared by diluting with water so that the sample may have a concentration of 0.50 mass %, and is filled into a disposable capillary cell (DTS1060). The cell is loaded into a cell holder of the apparatus.

When the above-mentioned preparation is finished, a Start button on a measurement display screen is pressed to perform a measurement.

The D50 is calculated based on data on a particle size distribution on a volume basis, which is obtained by converting a light intensity distribution obtained from a DLS measurement by the Mie theory.

EXAMPLES

The present invention is described below in more detail by way of specific production methods, Examples, and Comparative Examples. However, the present invention is by no means limited thereto. The number of parts and % in Examples and Comparative Examples are all based on a mass unless otherwise specified.

Synthesis Example of Polymerizable Monomer M-1

18.0 g of 2,4-dihydroxybenzoic acid was dissolved in 150 mL of methanol, and 36.9 g of potassium carbonate was added to the solution. The resultant was heated to 65° C. A mixed solution of 18.7 g of 4-(chloromethyl)styrene and 100 mL of methanol was dropped to the reaction liquid, and the resultant was allowed to react at 65° C. for 3 hours. The reaction liquid was cooled and then filtered, and the filtrate was concentrated to provide a crude product. The crude product was dispersed in 1.5 L of water having a pH of 2 and extracted with ethyl acetate. Then, the resultant was washed with water and dried with magnesium sulfate. Ethyl acetate was distilled away under reduced pressure. Thus, a precipitate was obtained. The precipitate was washed with hexane, and was then refined by recrystallization with toluene and ethyl acetate, to thereby provide 20.1 g of a polymerizable monomer M-1 represented by the following formula (9).

Formula (9)

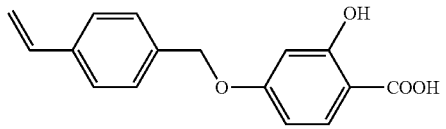

Synthesis Example of Polymerizable Monomer M-2

100 g of 2,5-dihydroxybenzoic acid and 1,441 g of 80% sulfuric acid were mixed by heating to 50° C. 144 g of tert-butyl alcohol was added to the dispersion liquid, and the mixture was stirred at 50° C. for 30 minutes. Then, the operation of adding 144 g of tert-butyl alcohol to the dispersion liquid, followed by stirring at 50° C. for 30 minutes was repeated three times. The reaction liquid was cooled to room temperature and slowly poured into 1 kg of ice water. A precipitate was filtered and washed with water, and was then washed with hexane. The resultant precipitate was dissolved in 200 mL of methanol and re-precipitated in 3.6 L of water. The resultant was filtrated and then dried at 80° C. to provide 74.9 g of a salicylic acid intermediate product represented by the following formula (10).

Formula (10)

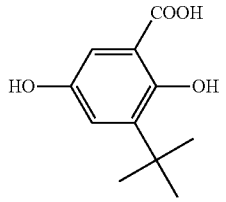

20.1 g of a polymerizable monomer M-2 represented by the following formula (11) was obtained in the same manner as in the polymerizable monomer M-1 except that 25.0 g of the salicylic acid intermediate product represented by the formula (10) was used instead of 18.0 g of 2,4-dihydroxybenzoic acid.

Formula (11)

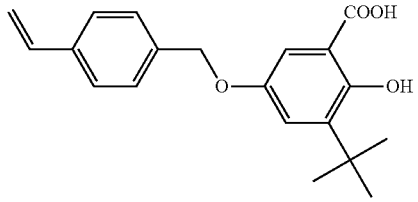

Synthesis Example of Polymerizable Monomer M-3

A salicylic acid intermediate product was obtained by the same method as that of the synthesis of the polymerizable monomer M-2 except that 253 g of 2-octanol was used instead of 144 g of tert-butyl alcohol. A polymerizable monomer M-3 represented by the following formula (12) was obtained by the same method as that of the synthesis example of the polymerizable monomer M-1 except that 32 g of the salicylic acid intermediate product obtained here was used.

Formula (12)

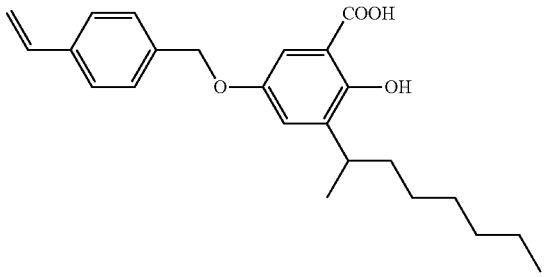

Synthesis Example of Polymerizable Monomer M-4

A polymerizable monomer M-4 represented by the following formula (13) was obtained by the same method as that of the synthesis example of the polymerizable monomer M-1 except that 18 g of 2,3-dihydroxybenzoic acid was used instead of 18.0 g of 2,4-dihydroxybenzoic acid.

Formula (13)

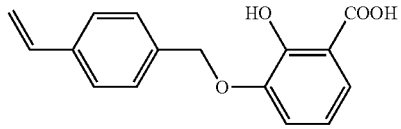

Synthesis Example of Polymerizable Monomer M-5

A polymerizable monomer M-5 represented by the following formula (14) was obtained by the same method as that of the synthesis example of the polymerizable monomer M-1 except that 18 g of 2,6-dihydroxybenzoic acid was used instead of 18.0 g of 2,4-dihydroxybenzoic acid.

Formula (14)

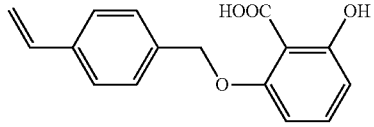

Synthesis Example of Polymerizable Monomer M-6

A polymerizable monomer M-6 represented by the following formula (15) was obtained by the same method as that of the synthesis example of the polymerizable monomer M-1 except that 18 g of 2,5-dihydroxy-3-methoxybenzoic acid was used instead of 18.0 g of 2,4-dihydroxybenzoic acid. In the formula (15), Me represents a methyl group.

Formula (15)

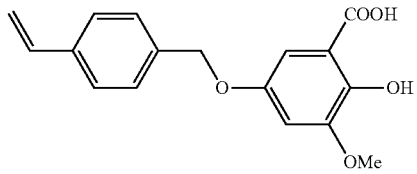

Synthesis Example of Polymer A-1

8.6 g of the polymerizable monomer M-1 represented by the formula (9) and 61.4 g of styrene were dissolved in 42.0 ml of N,N-Dimethylformamide (DMF), and the mixture was stirred for 1 hour with nitrogen bubbling and then heated to 110° C. A mixed solution of 2.1 g of tert-butylperoxy isopropyl monocarbonate (trade name: Perbutyl I, manufactured by NOF Corporation (previous corporate name: Nippon Oil and Fats Co., Ltd.)) and 42 ml of toluene, the mixed solution serving as an initiator, was dropped to the reaction liquid. Further, the resultant was allowed to react at 110° C. for 4 hours. Then, the resultant was cooled and dropped to 1 L of methanol, to thereby provide a precipitate. The obtained precipitate was dissolved in 120 ml of THF and then dropped to 1.80 L of methanol to precipitate a white precipitate. The resultant was filtered and dried at 90° C. under reduced pressure to provide 66.5 g of a polymer A-1. An NMR and an acid value of the obtained polymer A-1 were measured to confirm a content of a component derived from the polymerizable monomer M-1.

Polymer A-2 to Polymer A-9

A polymer A-2 to a polymer A-9 were obtained in the same manner as in the synthesis example of the polymer A-1 except that loading amounts of raw materials were changed as shown in Table 1.

Synthesis Example of Polymer B-1

200 parts by mass of xylene was loaded into a reaction vessel provided with a stirrer, a condenser, a thermometer, and a nitrogen introducing tube, and refluxed in a stream of nitrogen.

Next, the following substances were mixed, dropped to the reaction vessel with stirring, and the mixture was maintained for 10 hours.

| | |
|---|---|
| 1-Vinylnaphthalene-2-carboxylic acid | 5.3 parts by mass |
| Styrene | 75.0 parts by mass |
| 2-Ethylhexyl acrylate | 16.0 parts by mass |
| Dimethyl 2,2'-azobis(2-methylpropionate) | 5.0 parts by mass |

After that, a solvent was distilled away by distillation, and the residue was dried at 40° C. under reduced pressure to provide a polymer B-1. An NMR and an acid value of the obtained polymer B-1 were measured to confirm a content of the monovalent group a represented by the formula (2).

Synthesis Example of Polymer B-2

A polymer B-2 was obtained in the same manner as in the polymer B-1 except that 9.0 parts by mass of 5-vinylsalicylic acid was used instead of 5.3 parts by mass of 1-vinylnaphthalene-2-carboxylic acid in the synthesis example of the polymer B-1.

Synthesis Example of Polymer B-3

200.0 parts of xylene was loaded into a reaction vessel provided with a stirrer, a condenser, a thermometer, and a nitrogen introducing tube, and was refluxed in a stream of nitrogen. 6.0 parts by mass of 2-acrylamido-2-methylpropanesulfonic acid, 72.0 parts by mass of styrene, and 18.0 parts by mass of 2-ethylhexyl acrylate were mixed as monomers, and the mixture was dropped to the reaction vessel with stirring, and the liquid was maintained for 10 hours. After that, the solvent was distilled away by distillation, and the residue was dried under reduced pressure at 40° C. to provide a polymer B-3. An NMR and an acid value of the obtained polymer B-3 were measured to confirm a content of the monovalent group a represented by the formula (2).

Physical properties of the obtained polymer A-1 to polymer A-9 and polymer B-1 to polymer B-3 are shown in Table 1.

TABLE 1

| | Polymerizable monomer M | | | | | | | Weight-average | | Content of monovalent group a represented | Acid |
|---|---|---|---|---|---|---|---|---|---|---|---|
| | Kind | Loading amount (g) | St | 2EHA | BA | HEMA | Initiator | molecular weight (Mw) | Tg (° C.) | by formula (2) (μmol/g) | dissociation constant pKa |
| Polymer A-1 | Polymerizable monomer M-1 | 8.6 | 61.4 | 0.0 | 0.0 | 0.0 | 2.1 | 28,200 | 108.9 | 452 | 7.3 |
| Polymer A-2 | Polymerizable monomer M-1 | 8.0 | 51.5 | 0.0 | 10.5 | 0.0 | 2.1 | 30,300 | 83.2 | 421 | 7.0 |
| Polymer A-3 | Polymerizable monomer M-2 | 10.8 | 59.2 | 0.0 | 0.0 | 0.0 | 2.1 | 28,200 | 106.2 | 473 | 7.2 |
| Polymer A-4 | Polymerizable monomer M-3 | 11.7 | 58.3 | 0.0 | 0.0 | 0.0 | 2.1 | 30,000 | 107.2 | 438 | 7.3 |
| Polymer A-5 | Polymerizable monomer M-1 | 8.2 | 58.6 | 0.0 | 0.0 | 3.2 | 2.1 | 31,100 | 106.7 | 432 | 7.5 |
| Polymer A-6 | Polymerizable monomer M-4 | 8.4 | 61.6 | 0.0 | 0.0 | 0.0 | 2.1 | 29,500 | 105.3 | 445 | 7.6 |
| Polymer A-7 | Polymerizable monomer M-5 | 8.7 | 61.3 | 0.0 | 0.0 | 0.0 | 2.1 | 30,100 | 110.2 | 461 | 7.8 |
| Polymer A-8 | Polymerizable monomer M-6 | 8.3 | 46.3 | 15.4 | 0.0 | 0.0 | 2.1 | 29,500 | 70.5 | 397 | 8.0 |
| Polymer A-9 | Polymerizable monomer M-1 | 8.0 | 46.5 | 0.0 | 0.0 | 15.5 | 2.1 | 16,800 | 86.3 | 425 | 8.5 |
| Polymer B-1 | Described in specification | | | | | | | 15,600 | 91.4 | 0 | 8.8 |

TABLE 1-continued

| Polymerizable monomer M | | | | | | | Weight-average | | Content of monovalent group a represented | Acid |
|---|---|---|---|---|---|---|---|---|---|---|
| Kind | Loading amount (g) | St | 2EHA | BA | HEMA | Initiator | molecular weight (Mw) | Tg (° C.) | by formula (2) (μmol/g) | dissociation constant pKa |
| Polymer B-2 | Described in specification | | | | | | 14,400 | 75.2 | 0 | 6.6 |
| Polymer B-3 | Described in specification | | | | | | 24,500 | 68.9 | 0 | −0.6 |

St: styrene
2EHA: 2-ethylhexyl acrylate
BA: butyl acrylate
HEMA: 2-hydroxyethyl methacrylate

Production Example of Aqueous Dispersion of Resin Particles E-1

200.0 parts by mass of methyl ethyl ketone was loaded into a reaction vessel provided with a stirrer, a condenser, a thermometer, and a nitrogen introducing tube, and 100.0 parts by mass of the polymer A-1 was added to the mixture to be dissolved therein. Then, a 1.0 N potassium hydroxide aqueous solution was slowly added to the resultant and the mixture was stirred for 10 minutes. Then, 500.0 parts by mass of ion-exchanged water was slowly dropped to emulsify the resultant.

The solvent was removed by subjecting the obtained emulsion to distillation under reduced pressure, and ion-exchanged water was added to the resultant so that the concentration of the resin was adjusted to 20%. Thus, an aqueous dispersion of resin particles E-1 was obtained. Physical property values of the obtained aqueous dispersion of the resin particles E-1 are shown in Table 2.

Production Examples of Aqueous Dispersions of Resin Particles E-2 to Resin Particles E-19

Aqueous dispersions of resin particles E-2 to resin particles E-14 were obtained in the same manner as in the production example of the resin particles E-1 except that the amounts the polymer A-1 and the 1.0 N potassium hydroxide aqueous solution were changed as shown in Table 2. Physical property values of the obtained aqueous dispersions of the resin particles E-2 to the resin particles E-14 are shown in Table 2.

TABLE 2

| Aqueous dispersion | Kind of polymer | Amount of KOH (parts by mass) | Particle diameter D50 (nm) |
|---|---|---|---|
| Resin particles E-1 | Polymer A-1 | 40.1 | 40 |
| Resin particles E-2 | Polymer A-2 | 37.3 | 52 |
| Resin particles E-3 | Polymer A-3 | 41.8 | 42 |
| Resin particles E-4 | Polymer A-4 | 38.8 | 46 |
| Resin particles E-5 | Polymer A-5 | 36.0 | 64 |
| Resin particles E-6 | Polymer A-6 | 37.0 | 51 |
| Resin particles E-7 | Polymer A-7 | 38.4 | 49 |
| Resin particles E-8 | Polymer A-8 | 31.0 | 82 |
| Resin particles E-9 | Polymer A-9 | 37.6 | 73 |
| Resin particles E-10 | Polymer B-1 | 35.0 | 100 |
| Resin particles E-11 | Polymer B-2 | 49.9 | 72 |
| Resin particles E-12 | Polymer A-1 | 23.6 | 198 |
| Resin particles E-13 | Polymer B-3 | 35.4 | 56 |

Production Example of Polyester-Based Resin

(Synthesis of Isocyanate Group-Containing Prepolymer)

| | |
|---|---|
| Bisphenol A-ethylene oxide (2 mol) adduct | 725 parts by mass |
| Phthalic acid | 290 parts by mass |
| Dibutyltin oxide | 3.0 parts by mass |

The above-mentioned materials were allowed to react with stirring at 220° C. for 7 hours and further allowed to react under reduced pressure for 5 hours. Then, the resultant was cooled to 80° C. and allowed to react with 190 parts by mass of isophorone diisocyanate in ethyl acetate for 2 hours. Thus, an isocyanate group-containing polyester resin was obtained. 25 parts by mass of the isocyanate group-containing polyester resin and 1 part by mass of isophorone diamine were allowed to react at 50° C. for 2 hours, to thereby provide a polyester-based resin containing, as a main component, polyester containing a urea group. The obtained polyester-based resin had a weight-average molecular weight (Mw) of 22,300, a number-average molecular weight (Mn) of 2,980, and a peak molecular weight of 7,200.

Example 1

700 parts by mass of ion-exchanged water, 1,000 parts by mass of a 0.1 mol/L $Na_3PO_4$ aqueous solution, and 24.0 parts by mass of a 1.0 mol/L HCl aqueous solution were added to a five-necked pressure-resistant vessel provided with a reflux tube, a stirrer, a thermometer, and a nitrogen introducing tube. The mixture was kept at 63° C. with stirring at 12,000 rpm through use of a high-speed stirring device TK-homomixer. 85 parts by mass of a 1.0 mol/L $CaCl_2$ aqueous solution was gradually added to the resultant. Thus, an aqueous dispersion medium containing a fine poorly water-soluble dispersion stabilizer $Ca_3(PO_4)_2$ was prepared.

After that, a polymerizable monomer composition was produced by using the following raw materials. This step is defined as a dissolving step.

| | |
|---|---|
| Styrene monomer | 75.0 parts by mass |
| n-Butyl acrylate | 25.0 parts by mass |
| Divinylbenzene | 0.1 part by mass |
| Organosilicon compound (methyltriethoxysilane) | 15.0 parts by mass |
| Copper phthalocyanine pigment (Pigment Blue 15:3) | 6.5 parts by mass |
| Polyester-based resin | 6.0 parts by mass |
| Release agent (behenyl behenate) | 10.0 parts by mass |

The above-mentioned raw materials were dispersed with an attritor (manufactured by Nippon Coke & Engineering Co., Ltd.) for 3 hours to provide a polymerizable monomer composition. Then, the polymerizable monomer composition was transferred into another vessel and kept at 63° C. for 5 minutes with stirring. Then, 20.0 parts by mass of t-butyl peroxypivalate (50% toluene solution) serving as a polymerization initiator were added to the polymerizable monomer composition, and the resultant was kept for 5 minutes with stirring (dissolving step).

Then, the polymerizable monomer composition was loaded into the aqueous dispersion medium and granulated for 10 minutes with stirring with a high-speed stirring device (granulating step). After that, the high-speed stirring device was replaced by a propeller type stirrer, and the internal temperature was raised to 70° C. It took minutes to raise the temperature. Further, the resultant was allowed to react for 5 hours with slow stirring. The pH was 5.1. The step up to here is defined as a reaction 1 step.

Next, the pH was adjusted to 8.0 within 10 minutes by adding a 1.0 N NaOH aqueous solution to the resultant, and the temperature inside the vessel was raised to 85° C. It took 20 minutes to raise the temperature. Then, the inside of the vessel was kept at 85° C. for 3.0 hours. The step up to here is defined as a reaction 2 step.

After the completion of the reaction 2 step, the reflux tube was removed, and a distillation device capable of recovering a fraction was mounted on the vessel. Then, the temperature inside the vessel was raised to 100° C. It took 30 minutes to raise the temperature. After that, the temperature inside the vessel was kept at 100° C. for 5.0 hours. The step from the mounting of the distillation device capable of recovering a fraction on the vessel to the completion of the keeping of the vessel at 100° C. for 5.0 hours is defined as a distillation step. Further, the temperature to be kept was defined as a distillation temperature, and the time during which the temperature was kept was defined as a distillation time. In this step, a residual monomer and other solvents were removed. A small amount of matters in the vessel at the beginning of the distillation and at the end thereof were taken out, and the pH thereof at 85° C. was measured to be 8.0 in both cases.

After the completion of the distillation, the vessel was cooled to 90° C., and 3.2 parts by mass (solid content: 0.64 part by mass) of an aqueous dispersion of the resin particles E-1 was dropped to the vessel over 10 minutes. After that, the inside of the vessel was kept at 90° C. for 1.0 hour. The step up to here is defined as a resin particle sticking step.

After the resin particle sticking step, the vessel was cooled to 30° C., and diluted hydrochloric acid was added to the vessel to decrease the pH to 1.5. Then, a dispersion stabilizer was dissolved in the resultant, further followed by filtration. After the filtration, 700 parts by mass of ion-exchanged water was further added to the resultant without taking out an obtained cake, and the mixture was subjected again to filtration and washing.

Next, the cake after the filtration was taken out and dried in a vacuum at 30° C. for 1 hour. Particles obtained here are defined as toner particles.

Further, fine and coarse powders were cut by pneumatic classification. Particles thus obtained are defined as a toner. The formulation and production conditions of the toner particles and the toner are shown in Table 3, and the physical properties of toner particles are shown in Table 4. In Table 4, "ESCA dSi value" represents ratio of silicon atom density dSi with respect to total of 100.0 atomic % of carbon atom density dC, oxygen atom density dO, and silicon atom density dSi on the surface of the toner particle in X-ray photoelectron spectroscopic analysis of surface of toner particle.

A toner 1 thus obtained was evaluated as described below.

Figure 3:
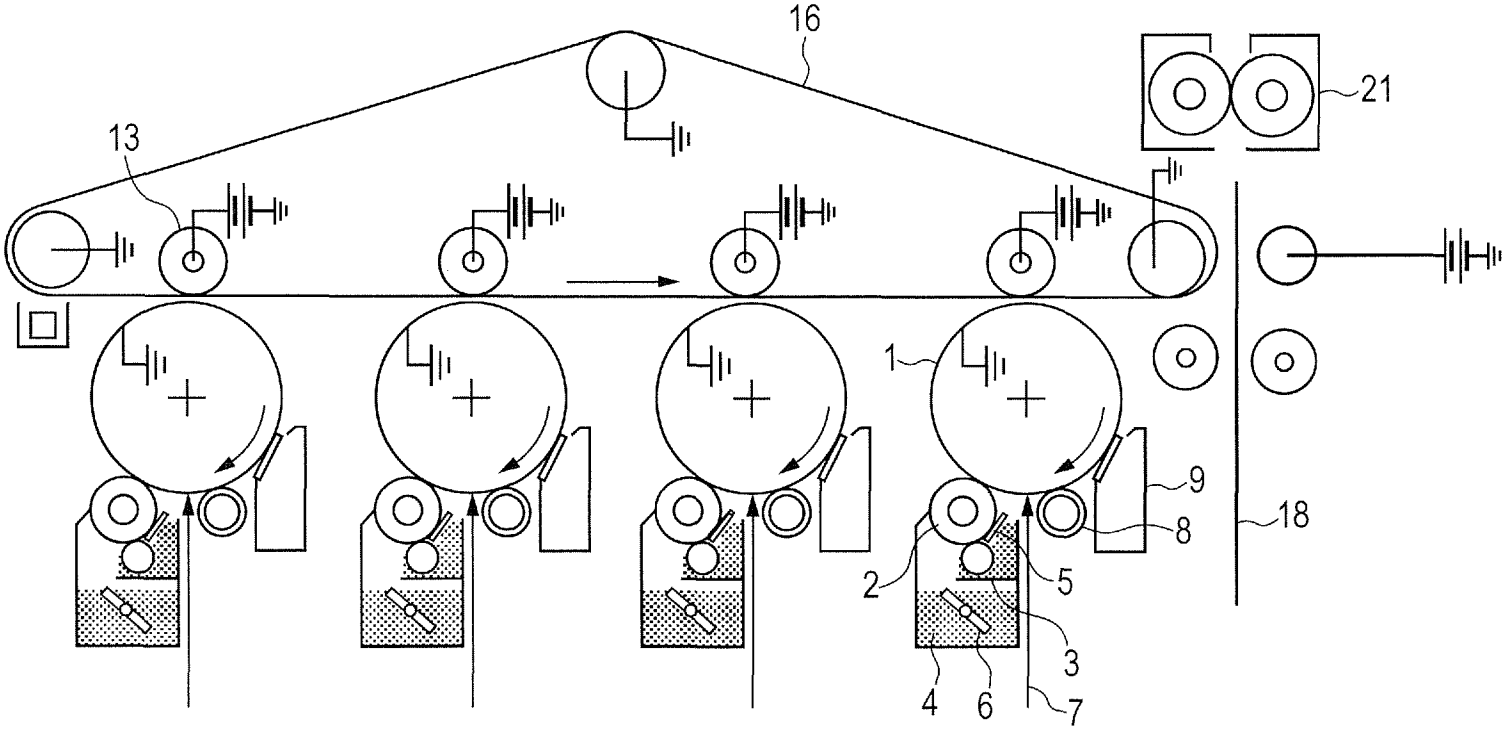
FIG. 3 is an illustration of an example of an electrophotographic apparatus to which the present invention is applicable.

A tandem-type laser beam printer LBP9510C manufactured by Canon Inc. having a configuration as illustrated in FIG. 3 was remodeled so as to be capable of performing printing only with a cyan station. The tandem-type laser beam printer LBP9510C was also remodeled so that a transfer current was able to be set arbitrarily. In FIG. 3, there are illustrated a photosensitive member (elestrostatic charge image-bearing member) 1, a toner bearing member 2, a supplying roller 3, a toner 4, a regulating blade 5, a toner container 6, exposure light 7, a charging roller 8, a cleaning device 9, a transfer roller 13, an intermediate transfer belt 16, a transfer member (recording paper) 18, and a fixing device 21. A toner cartridge for the LBP9510C was used, and 200 g of the toner was filled into the toner cartridge. Then, the toner cartridge was left to stand for 3 days under a high-temperature and high-humidity (H/H) (32.5° C./85% RH) environment. After being left to stand for 3 days under the high-temperature and high-humidity (H/H) environment, the toner cartridge was mounted on the LBP9510C, and a transfer latitude, an image density, and chargeability in an initial stage were evaluated. After that, an image having a printing ratio of 1.0% was printed out onto 15,000 sheets of A4 paper in a lateral direction, and a transfer latitude, an image density, and chargeability, after the output of the 15,000 sheets of paper (after endurance) were evaluated. The results are shown in Table 5.

<Transfer Latitude>

The transfer current was changed in 2 μA steps from 2 μA to 20 μA in the initial stage and after the printing of the 15,000 sheets of paper. A solid image was output in each step, and a transfer residual toner on the photosensitive member after the transfer of the solid image was scraped off by taping of a Mylar tape. Then, the tape and a tape that was not used for taping were attached onto a letter-size XEROX 4200 sheet (manufactured by Xerox Corporation, 75 g/m$^2$). Transferability was evaluated based on a numerical value obtained by subtracting a reflectance Dr (%) of the tape attached to the sheet without being used for taping from a reflectance Ds (%) of the tape.

A transfer current range in which the numerical value of transferability was 2.0 or less was defined as a transfer latitude. As the transfer current range widens, the result of the transfer latitude becomes more satisfactory.

The reflectance was measured by using "REFLECTOMETER MODEL TC-6DS" (manufactured by Tokyo Denshoku Co., Ltd.) with an amber filter mounted thereto.

<Image Density>

In the initial stage and after the output of the 15,000 sheets of paper, a sample image, which had 20-millimeter square solid black images printed at four corners and a center of a sheet surface, was output, and an average density at those five points was measured. The image density was obtained by measuring a density relative to an image in a white ground portion having an original density of 0.00 through use of "Macbeth reflection densitometer RD918" (manufactured by Macbeth).

<Chargeability>

In the initial stage and after the output of the 15,000 sheets of paper, the toner was removed from the cartridge, and a two-component developer was produced in each step as described below.

In order to evaluate a charge quantity, a sample was prepared as described below. 18.6 g of a magnetic carrier F813-300 (manufactured by Powdertech Co., Ltd.) and 1.4 g of an evaluation toner were loaded into a 50 cc plastic bottle with a cover, and shaken with a shaker (YS-LD: manufactured by Yayoi Co., Ltd.) for 1 minute at a speed of 2 rounds per second.

Regarding the toner and the two-component developer, evaluations were carried out as described below.

<Evaluation of Toner Charge Quantity Under High Temperature and High Humidity>

Figure 4:
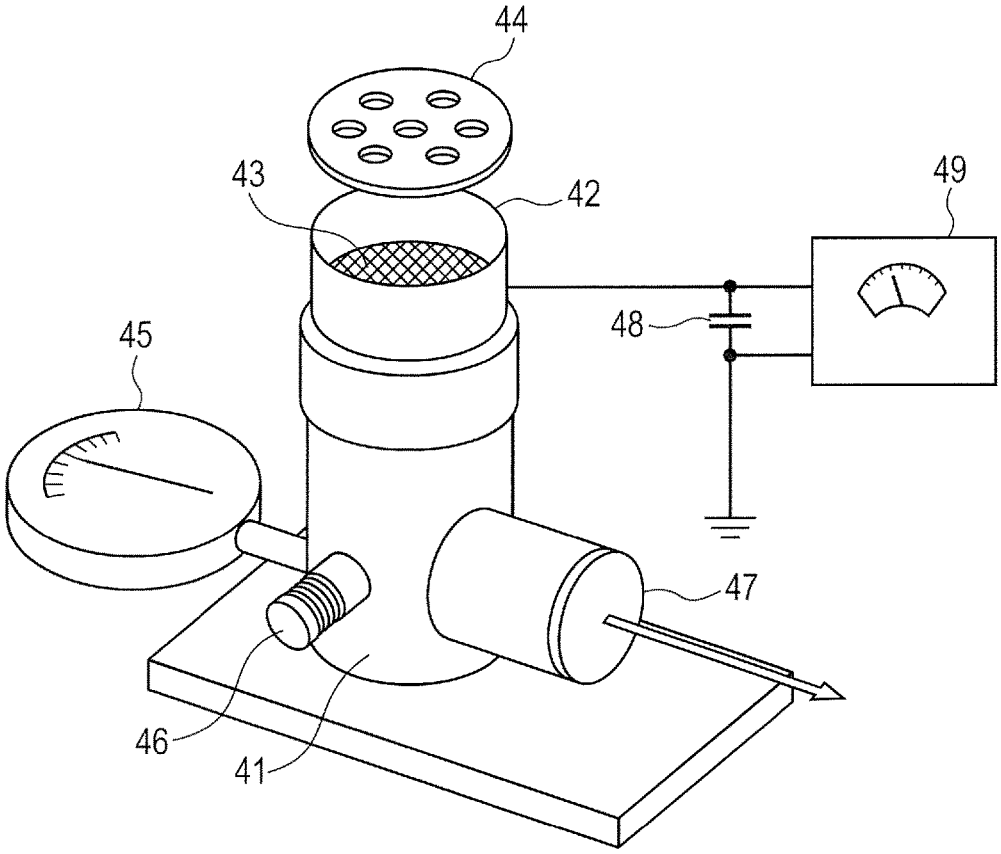
FIG. 4 is an illustration of a measurement apparatus of a charge quantity in the present invention.

A charge quantity was obtained by leaving a two-component developer to stand under a high-temperature and high-humidity environment (32.5° C./85% RH) for 3 days, shaking the two-component developer for 3 minutes at a speed of 200 times/minute, and measuring a toner charge quantity through use of an apparatus of FIG. 4.

(Measurement Method for Charge Quantity)

0.500 g of a two-component developer to be measured for triboelectric charge quantity is loaded into a metallic measurement vessel 42 having a 500-mesh (mesh size: 25 μm) screen 43 arranged on a bottom illustrated in FIG. 4, and the measurement vessel 42 is covered with a metallic cover 44. At this time, the entire measurement vessel 42 is weighed, and the obtained weight is defined as W1 (g). Then, in a suction machine 41 (at least a portion that is held in contact with the measurement vessel 42 is made of an insulator), an air volume regulation valve 46 is adjusted by performing suction through a suction port 47, to thereby set the pressure of a vacuum gauge 45 to 250 mmAq. In this state, suction is performed sufficiently, preferably for 2 minutes, to remove a toner from the two-component developer by suction.

The potential of an electrometer 49 in this case is defined as V (volt). There is provided a condenser 48, and the capacity thereof is defined as C (μF). The entire measurement vessel after the suction is weighed, and the obtained weight is defined as W2 (g). The triboelectric charge quantity of the toner is calculated by the following expression.

$$\text{Triboelectric charge quantity (mC/kg)}=(C\times V)/(W1-W2)$$

As the obtained charge quantity is larger, and the difference between the charge quantity in the initial stage and the charge quantity after the printing of the 15,000 sheets of paper is smaller, it is understood that better results are obtained.

Example 2 to Example 30, and Example 33 and Example 34

Toner particles and toners were produced in accordance with the production conditions and formulations shown in Table 3, and in accordance with the other conditions in Example 1. The physical properties of the obtained toner particles are shown in Table 4. Further, the evaluation results are shown in Table 5. Methods for distillation under reduced pressure and distillation under pressure are described below.

The distillation under reduced pressure was performed by mounting a pressure reducer on an open port and reducing pressure to such a degree that a toner was not sucked toward a side closer to the distillation device configured to recover a fraction.

The distillation under pressure was performed by mounting a pressurizer on an open port and mounting a valve on the side closer to the distillation device so that a toner was not influenced by pressure. During distillation, the valve on the side closer to the distillation device was opened once every 5 minutes to return the pressure to normal pressure, and volatile portions were recovered.

Example 31

Toner particles were obtained in accordance with Example 1 except that the resin particle sticking step was not performed.

The aqueous dispersion of the resin particles E-1 was dried to provide a dried product of the resin particles E-1. The obtained dried product of the resin particles E-1 was frozen and pulverized to provide a frozen and pulverized product of the resin particles E-1.

0.5 part by mass of the frozen and pulverized product of the resin particles E-1 was added to 100.0 parts by mass of the dried toner particles, and the mixture was loaded into a dry particle compounding device (Nobilta NOB-130 manufactured by Hosokawa Micron Corporation). The resin particles E-1 were stuck to the toner particles under the conditions of a treatment temperature of 30° C. and a speed of a rotary treatment blade of 90 m/sec. to provide toner particles 31. Further, fine and coarse powders were cut by pneumatic classification. Particles thus obtained are defined as a toner 31. The physical properties of the toner particles 31 are shown in Table 4. The toner 31 was evaluated in the same manner as in Example 1, and the results are shown in Table 5.

Example 32

The process up to the reaction 1 step was performed in accordance with Example 1.

After the completion of the reaction 1 step, the pH was adjusted to 8.0 within 10 minutes by adding a 1.0 N NaOH aqueous solution to the resultant, and 3.2 parts by mass (solid content: 0.6 part by mass) of the aqueous dispersion of the resin particles E-1 was dropped to the vessel over 10 minutes. After that, the inside of the vessel was raised to 85° C. It took 20 minutes to raise the temperature. Then, the inside of the vessel was kept at 85° C. for 3.0 hours.

Next, the reflux tube was removed, and a distillation device capable of recovering a fraction was mounted on the vessel. Then, the temperature inside the vessel was raised to 100° C. It took 30 minutes to raise the temperature. After that, the temperature inside the vessel was kept at 100° C. for 5.0 hours. The step from the mounting of the distillation device capable of recovering a fraction on the vessel to the completion of the keeping of the vessel at 100° C. for 5.0 hours is defined as a distillation step. Further, the temperature to be kept was defined as a distillation temperature, and the time during which the temperature was kept was defined as a distillation time. In this step, a residual monomer and other solvents were removed. A small amount of matters in the vessel at the beginning of the distillation and at the end thereof were taken out, and the pH thereof at 85° C. was measured to be 8.0 in both cases. The vessel was cooled to 30° C., and diluted hydrochloric acid was added to the vessel to decrease the pH to 1.5. Then, a dispersion stabilizer was dissolved in the resultant, further followed by filtration. After the filtration, 700 parts by mass of ion-exchanged water was further added to the resultant without taking out an obtained cake, and the mixture was subjected again to filtration and washing.

Next, the cake after the filtration was taken out and dried in a vacuum at 30° C. for 1 hour. Particles obtained here are defined as toner particles.

Further, fine and coarse powders were cut by pneumatic classification. Particles thus obtained are defined as a toner 32. The physical properties of toner particles 32 are shown in Table 4. The toner 32 was evaluated in the same manner as in Example 1, and the results are shown in Table 5.

Comparative Example 1 to Comparative Example 3

Toner particles and toners were produced in accordance with the production conditions and formulations shown in Table 3, and in accordance with the other conditions in Example 1. The physical properties of the obtained toner particles are shown in Table 4. Further, the resultant toners were evaluated in the same manner as in Example 1, and the results are shown in Table 5. Methods for distillation under reduced pressure and distillation under pressure are described below.

The distillation under reduced pressure was performed by mounting a pressure reducer on an open port and reducing pressure to such a degree that a toner was not sucked toward a side closer to the distillation device configured to recover a fraction.

The distillation under pressure was performed by mounting a pressurizer on an open port and mounting a valve on the side closer to the distillation device so that a toner was not influenced by pressure. During distillation, the valve on the side closer to the distillation device was opened once every 5 minutes to return the pressure to normal pressure, and volatile portions were recovered.

Comparative Example 4

The process up to the distillation step was performed in accordance with Example 1 except that the raw materials to be used in the polymerizable monomer composition of Example 1 were changed to the following materials.

| | |
|---|---|
| Styrene monomer | 75.0 parts by mass |
| n-Butyl acrylate | 25.0 parts by mass |
| Divinylbenzene | 0.1 part by mass |
| Polymer A-1 | 0.5 part by mass |
| Copper phthalocyanine pigment (Pigment Blue 15:3) | 6.5 parts by mass |
| Polyester-based resin | 6.0 parts by mass |
| Release agent [behenyl behenate] | 10.0 parts by mass |

After the completion of the distillation step, the vessel was cooled to 30° C., and diluted hydrochloric acid was added to the vessel to decrease the pH to 1.5. Then, a dispersion stabilizer was dissolved in the resultant, further followed by filtration. After the filtration, 700 parts by mass of ion-exchanged water was further added to the resultant without taking out an obtained cake, and the mixture was subjected again to filtration and washing.

Next, the cake after the filtration was taken out and dried in a vacuum at 30° C. for 1 hour. Particles obtained here are defined as toner particles 38.

Further, fine and coarse powders were cut by pneumatic classification. After that, 2.0 parts by mass of hydrophobic silica fine powder was mixed with 100.0 parts by mass of the toner particles 38 by using a Henschel mixer (manufactured by Mitsui Miike Machinery Co., Ltd.) at 3,000 rpm for 15 minutes. Thus, a toner 38 was obtained. Powder treated with dimethylsilicone oil (20 mass %) serving as a flow improver, the powder having a number-average primary particle diameter of 10 nm and a BET specific surface area of 170 $m^2/g$, was used as the hydrophobic silica fine powder. The particles thus obtained were defined as a toner 38. The physical properties of the toner particles 38 are shown in Table 4. The obtained toner 38 was evaluated in the same manner as in Example 1, and the results are shown in Table 5.

TABLE 3

| | | Organosilicon compound | Addition amount of organosilicon compound (parts) | Temperature of reaction 2 (° C.) | Time of reaction 2 (hr) | pH of reaction 2 | Distillation temperature (° C.) | Distillation method | Distillation time (hr) |
|---|---|---|---|---|---|---|---|---|---|
| Example 1 | Toner 1 | Methyltriethoxysilane | 15.0 | 85 | 3 | 8.0 | 100 | Distillation under normal pressure | 5 |
| Example 2 | Toner 2 | Ethyltriethoxysilane | 15.0 | 85 | 3 | 8.0 | 100 | Distillation under normal pressure | 5 |
| Example 3 | Toner 3 | Butyltriethoxysilane | 15.0 | 85 | 3 | 8.0 | 100 | Distillation under normal pressure | 5 |
| Example 4 | Toner 4 | Hexyltriethoxysilane | 15.0 | 85 | 3 | 8.0 | 100 | Distillation under normal pressure | 5 |
| Example 5 | Toner 5 | Phenyltriethoxysilane | 15.0 | 85 | 3 | 8.0 | 100 | Distillation under normal pressure | 5 |
| Example 6 | Toner 6 | Ethyltriethoxysilane | 15.0 | 75 | 5 | 8.0 | 75 | Distillation under normal pressure | 8 |
| Example 7 | Toner 7 | Ethyltriethoxysilane | 15.0 | 80 | 3 | 8.0 | 80 | Distillation under normal pressure | 5 |
| Example 8 | Toner 8 | Ethyltriethoxysilane | 15.0 | 85 | 3 | 8.0 | 80 | Distillation under reduced pressure | 5 |
| Example 9 | Toner 9 | Ethyltriethoxysilane | 15.0 | 90 | 3 | 8.0 | 90 | Distillation under reduced pressure | 5 |
| Example 10 | Toner 10 | Ethyltriethoxysilane | 15.0 | 90 | 3 | 8.0 | 95 | Distillation under normal pressure | 5 |
| Example 11 | Toner 11 | Methyltriethoxysilane | 15.0 | 85 | 3 | 8.0 | 100 | Distillation under normal pressure | 5 |
| Example 12 | Toner 12 | Methyltriethoxysilane | 15.0 | 85 | 3 | 8.0 | 100 | Distillation under normal pressure | 5 |
| Example 13 | Toner 13 | Methyltriethoxysilane | 15.0 | 85 | 3 | 8.0 | 100 | Distillation under normal pressure | 5 |

TABLE 3-continued

| | | | | | | | | | |
|---|---|---|---|---|---|---|---|---|---|
| Example 14 | Toner 14 | Methyltriethoxysilane | 15.0 | 85 | 3 | 8.0 | 100 | Distillation under normal pressure | 5 |
| Example 15 | Toner 15 | Methyltriethoxysilane | 15.0 | 85 | 3 | 8.0 | 100 | Distillation under normal pressure | 5 |
| Example 16 | Toner 16 | Methyltriethoxysilane | 15.0 | 85 | 3 | 8.0 | 100 | Distillation under normal pressure | 5 |
| Example 17 | Toner 17 | Methyltriethoxysilane | 15.0 | 85 | 3 | 8.0 | 100 | Distillation under normal pressure | 5 |
| Example 18 | Toner 18 | Methyltriethoxysilane | 15.0 | 85 | 3 | 8.0 | 100 | Distillation under normal pressure | 5 |
| Example 19 | Toner 19 | Methyltriethoxysilane | 15.0 | 85 | 3 | 8.0 | 100 | Distillation under normal pressure | 5 |
| Example 20 | Toner 20 | Methyltriethoxysilane | 15.0 | 85 | 3 | 8.0 | 100 | Distillation under normal pressure | 5 |
| Example 21 | Toner 21 | Methyltriethoxysilane | 15.0 | 85 | 3 | 8.0 | 100 | Distillation under normal pressure | 5 |
| Example 22 | Toner 22 | Methyltriethoxysilane | 15.0 | 85 | 3 | 8.0 | 100 | Distillation under normal pressure | 5 |
| Example 23 | Toner 23 | Methyltriethoxysilane | 15.0 | 85 | 3 | 8.0 | 100 | Distillation under normal pressure | 5 |
| Example 24 | Toner 24 | Methyltriethoxysilane | 15.0 | 85 | 3 | 8.0 | 100 | Distillation under normal pressure | 5 |
| Example 25 | Toner 25 | Methyltriethoxysilane | 15.0 | 85 | 3 | 8.0 | 100 | Distillation under normal pressure | 5 |
| Example 26 | Toner 26 | Methyltriethoxysilane | 15.0 | 85 | 3 | 8.0 | 100 | Distillation under normal pressure | 5 |
| Example 27 | Toner 27 | Methyltriethoxysilane | 38.0 | 85 | 3 | 8.0 | 108 | Distillation under pressure | 8 |
| Example 28 | Toner 28 | Methyltriethoxysilane | 25.0 | 85 | 3 | 8.0 | 105 | Distillation under pressure | 8 |
| Example 29 | Toner 29 | Methyltriethoxysilane | 7.0 | 85 | 3 | 8.0 | 100 | Distillation under normal pressure | 5 |
| Example 30 | Toner 30 | Methyltriethoxysilane | 6.0 | 85 | 3 | 8.0 | 100 | Distillation under normal pressure | 5 |
| Example 31 | Toner 31 | Methyltriethoxysilane | | | Described in specification | | | | |
| Example 32 | Toner 32 | Methyltriethoxysilane | | | Described in specification | | | | |
| Example 33 | Toner 33 | Methyltriethoxysilane | 15.0 | 85 | 3 | 8.0 | 100 | Distillation under normal pressure | 5 |
| Example 34 | Toner 34 | Methyltriethoxysilane | 15.0 | 85 | 3 | 8.0 | 100 | Distillation under normal pressure | 5 |
| Comparative Example 1 | Toner 35 | Hexyltriethoxysilane | 5.0 | 70 | 3 | 8.0 | 70 | Distillation under reduced pressure | 5 |
| Comparative Example 2 | Toner 36 | Hexyltriethoxysilane | 6.5 | 70 | 3 | 7.0 | 70 | Distillation under reduced pressure | 5 |
| Comparative Example 3 | Toner 37 | Methyltriethoxysilane | 15.0 | 85 | 3 | 8.0 | 100 | Distillation under normal pressure | 5 |
| Comparative Example 4 | Toner 38 | None | | | Described in specification | | | | |

| | | pH of distillation | Addition timing of resin particles | Resin parti-cles | Addition number of parts of aqueous dispersion of resin particles (parts) | Number of parts of solid content of resin particles (parts) | Addi-tion pH of resin parti-cles | Addition temperature of resin particles (° C.) | Stick-ing time of resin parti-cles (hr) |
|---|---|---|---|---|---|---|---|---|---|
| Example 1 | Toner 1 | 8.0 | After distillation | E-1 | 3.2 | 0.6 | 8.0 | 90 | 1.0 |
| Example 2 | Toner 2 | 8.0 | After distillation | E-1 | 3.2 | 0.6 | 8.0 | 90 | 1.0 |
| Example 3 | Toner 3 | 8.0 | After distillation | E-1 | 3.2 | 0.6 | 8.0 | 90 | 1.0 |
| Example 4 | Toner 4 | 8.0 | After distillation | E-1 | 3.2 | 0.6 | 8.0 | 90 | 1.0 |
| Example 5 | Toner 5 | 8.0 | After distillation | E-1 | 3.2 | 0.6 | 8.0 | 90 | 1.0 |
| Example 6 | Toner 6 | 8.0 | After distillation | E-1 | 3.2 | 0.6 | 8.0 | 90 | 1.0 |
| Example 7 | Toner 7 | 8.0 | After distillation | E-1 | 3.2 | 0.6 | 8.0 | 90 | 1.0 |
| Example 8 | Toner 8 | 8.0 | After distillation | E-1 | 3.2 | 0.6 | 8.0 | 90 | 1.0 |
| Example 9 | Toner 9 | 8.0 | After distillation | E-1 | 3.2 | 0.6 | 8.0 | 90 | 1.0 |
| Example 10 | Toner 10 | 8.0 | After distillation | E-1 | 3.2 | 0.6 | 8.0 | 90 | 1.0 |
| Example 11 | Toner 11 | 8.0 | After distillation | E-1 | 0.6 | 0.1 | 8.0 | 90 | 1.0 |

TABLE 3-continued

| | | | | | | | | | |
|---|---|---|---|---|---|---|---|---|---|
| Example 12 | Toner 12 | 8.0 | After distillation | E-1 | 1.6 | 0.3 | 8.0 | 90 | 1.0 |
| Example 13 | Toner 13 | 8.0 | After distillation | E-1 | 2.6 | 0.5 | 8.0 | 90 | 1.0 |
| Example 14 | Toner 14 | 8.0 | After distillation | E-1 | 6.4 | 1.3 | 8.0 | 90 | 1.0 |
| Example 15 | Toner 15 | 8.0 | After distillation | E-1 | 15.4 | 3.1 | 8.0 | 90 | 1.0 |
| Example 16 | Toner 16 | 8.0 | After distillation | E-1 | 16.7 | 3.3 | 8.0 | 90 | 1.0 |
| Example 17 | Toner 17 | 8.0 | After distillation | E-2 | 3.2 | 0.6 | 8.0 | 85 | 1.0 |
| Example 18 | Toner 18 | 8.0 | After distillation | E-3 | 3.2 | 0.6 | 8.0 | 90 | 1.0 |
| Example 19 | Toner 19 | 8.0 | After distillation | E-4 | 3.2 | 0.6 | 8.0 | 90 | 1.0 |
| Example 20 | Toner 20 | 8.0 | After distillation | E-5 | 3.2 | 0.6 | 8.0 | 90 | 1.0 |
| Example 21 | Toner 21 | 8.0 | After distillation | E-6 | 3.2 | 0.6 | 8.0 | 90 | 1.0 |
| Example 22 | Toner 22 | 8.0 | After distillation | E-7 | 3.2 | 0.6 | 8.0 | 90 | 1.0 |
| Example 23 | Toner 23 | 8.0 | After distillation | E-8 | 3.2 | 0.6 | 8.0 | 70 | 1.0 |
| Example 24 | Toner 24 | 8.0 | After distillation | E-9 | 3.2 | 0.6 | 8.0 | 90 | 1.0 |
| Example 25 | Toner 25 | 8.0 | After distillation | E-10 | 3.2 | 0.6 | 8.0 | 90 | 1.0 |
| Example 26 | Toner 26 | 8.0 | After distillation | E-11 | 3.2 | 0.6 | 8.0 | 75 | 1.0 |
| Example 27 | Toner 27 | 8.0 | After distillation | E-1 | 3.4 | 0.7 | 8.0 | 90 | 1.0 |
| Example 28 | Toner 28 | 8.0 | After distillation | E-1 | 3.3 | 0.7 | 8.0 | 90 | 1.0 |
| Example 29 | Toner 29 | 8.0 | After distillation | E-1 | 1.6 | 0.3 | 8.0 | 90 | 1.0 |
| Example 30 | Toner 30 | 8.0 | After distillation | E-1 | 1.6 | 0.3 | 8.0 | 90 | 1.0 |
| Example 31 | Toner 31 | | | Described in specification | | | | | |
| Example 32 | Toner 32 | | | Described in specification | | | | | |
| Example 33 | Toner 33 | 8.0 | After distillation | E-12 | 31.9 | 6.4 | 8.0 | 90 | 1.0 |
| Example 34 | Toner 34 | 8.0 | After distillation | E-1 | 19.2 | 3.8 | 8.0 | 70 | 1.0 |
| Comparative Example 1 | Toner 35 | 8.0 | After distillation | E-1 | 1.5 | 0.3 | 8.0 | 90 | 1.0 |
| Comparative Example 2 | Toner 36 | 7.0 | After distillation | E-1 | 1.5 | 0.3 | 8.0 | 90 | 1.0 |
| Comparative Example 3 | Toner 37 | 8.0 | After distillation | E-13 | 3.2 | 0.6 | 8.0 | 70 | 1.0 |
| Comparative Example 4 | Toner 38 | | | Described in specification | | | | | |

TABLE 4

| | | | Organosilicon polymer in toner particle | | | | |
|---|---|---|---|---|---|---|---|
| Toner particles | Weight-average particle diameter of toner particles D4 (μm) | Kind of organosilicon compound | Carbon number of $R^0$ (atoms) | Ratio of peak area for partial structure represented by formula (1) (%) | ESCA dSi value (atomic %) | Average thickness of surface layer Dav. (nm) | Ratio of average thickness of 2.5 mm or less (number %) |
| Toner particles 1 | 6.1 | Methyltriethoxysilane | 1 | 69.9 | 22.3 | 25.1 | 0 |
| Toner particles 2 | 6.2 | Ethyltriethoxysilane | 2 | 65.2 | 21.6 | 24.3 | 0 |
| Toner particles 3 | 6.0 | Butyltriethoxysilane | 4 | 51.6 | 20.3 | 24.9 | 0 |
| Toner particles 4 | 6.4 | Hexyltriethoxysilane | 6 | 39.8 | 18.7 | 23.9 | 0 |
| Toner particles 5 | 6.1 | Phenyltriethoxysilane | 6 | 28.5 | 18.6 | 25.0 | 0 |
| Toner particles 6 | 6.2 | Ethyltriethoxysilane | 2 | 6.2 | 4.6 | 19.8 | 0 |
| Toner particles 7 | 6.3 | Ethyltriethoxysilane | 2 | 12.3 | 9.5 | 20.2 | 0 |
| Toner particles 8 | 6.1 | Ethyltriethoxysilane | 2 | 30.2 | 11.3 | 23.1 | 0 |
| Toner particles 9 | 6.2 | Ethyltriethoxysilane | 2 | 41.0 | 14.7 | 24.5 | 0 |
| Toner particles 10 | 6.2 | Ethyltriethoxysilane | 2 | 64.8 | 20.5 | 25.0 | 0 |
| Toner particles 11 | 6.1 | Methyltriethoxysilane | 1 | 70.0 | 26.0 | 20.3 | 0 |
| Toner particles 12 | 6.2 | Methyltriethoxysilane | 1 | 71.0 | 24.6 | 22.4 | 0 |

TABLE 4-continued

| Toner particles | Weight-average particle diameter of toner particles D4 (μm) | Kind of organosilicon compound | Organosilicon polymer in toner particle: Carbon number of $R^0$ (atoms) | Ratio of peak area for partial structure represented by formula (1) (%) | ESCA dSi value (atomic %) | Average thickness of surface layer Dav. (nm) | Ratio of average thickness of 2.5 mm or less (number %) |
|---|---|---|---|---|---|---|---|
| Toner particles 13 | 6.1 | Methyltriethoxysilane | 1 | 70.5 | 23.1 | 25.3 | 0 |
| Toner particles 14 | 6.0 | Methyltriethoxysilane | 1 | 71.1 | 17.4 | 35.3 | 0 |
| Toner particles 15 | 6.1 | Methyltriethoxysilane | 1 | 70.7 | 4.2 | 51.6 | 0 |
| Toner particles 16 | 6.1 | Methyltriethoxysilane | 1 | 70.8 | 1.8 | 53.4 | 0 |
| Toner particles 17 | 6.2 | Methyltriethoxysilane | 1 | 69.9 | 22.6 | 25.3 | 0 |
| Toner particles 18 | 6.1 | Methyltriethoxysilane | 1 | 70.1 | 21.3 | 24.7 | 0 |
| Toner particles 19 | 6.2 | Methyltriethoxysilane | 1 | 70.2 | 21.6 | 24.2 | 0 |
| Toner particles 20 | 6.1 | Methyltriethoxysilane | 1 | 70.0 | 21.3 | 24.2 | 0 |
| Toner particles 21 | 6.0 | Methyltriethoxysilane | 1 | 70.6 | 22.5 | 25.1 | 0 |
| Toner particles 22 | 6.1 | Methyltriethoxysilane | 1 | 70.3 | 21.0 | 25.3 | 0 |
| Toner particles 23 | 6.3 | Methyltriethoxysilane | 1 | 69.8 | 25.8 | 26.1 | 0 |
| Toner particles 24 | 6.2 | Methyltriethoxysilane | 1 | 69.9 | 24.6 | 21.2 | 0 |
| Toner particles 25 | 6.1 | Methyltriethoxysilane | 1 | 70.4 | 26.1 | 20.5 | 0 |
| Toner particles 26 | 6.1 | Methyltriethoxysilane | 1 | 70.2 | 24.8 | 30.2 | 0 |
| Toner particles 27 | 6.2 | Methyltriethoxysilane | 1 | 70.3 | 23.1 | 84.3 | 0 |
| Toner particles 28 | 6.1 | Methyltriethoxysilane | 1 | 70.4 | 22.3 | 50.1 | 0 |
| Toner particles 29 | 6.2 | Methyltriethoxysilane | 1 | 70.3 | 6.2 | 5.4 | 18.8 |
| Toner particles 30 | 6.2 | Methyltriethoxysilane | 1 | 70.0 | 5.8 | 4.7 | 37.5 |
| Toner particles 31 | 6.2 | Methyltriethoxysilane | 1 | 70.1 | 25.1 | 26.1 | 0 |
| Toner particles 32 | 6.1 | Methyltriethoxysilane | 1 | 70.1 | 21.3 | 24.1 | 0 |
| Toner particles 33 | 6.1 | Methyltriethoxysilane | 1 | 70.2 | 17.2 | 86.5 | 0 |
| Toner particles 34 | 6.3 | Methyltriethoxysilane | 1 | 70.0 | 0.0 | 58.2 | 0 |
| Toner particles 35 | 6.5 | Hexyltriethoxysilane | 6 | 4.5 | 2.0 | 4.3 | 40.6 |
| Toner particles 36 | 6.4 | Hexyltriethoxysilane | 6 | 4.1 | 4.2 | 5.6 | 14.5 |
| Toner particles 37 | 6.1 | Methyltriethoxysilane | 1 | 70.2 | 21.3 | 25.3 | 0 |
| Toner particles 38 | 6.5 | — | — | 0.0 | 0.0 | 0.0 | 0 |

TABLE 5

| Example | Toner | Transfer latitude (μA): Initial | Transfer latitude (μA): After endurance | Image density: Initial/after endurance | Charge quantity (mC/kg): Initial/after endurance |
|---|---|---|---|---|---|
| Example 1 | Toner 1 | 2 to 20 | 4 to 20 | 1.50/1.50 | −65.1/−62.3 |
| Example 2 | Toner 2 | 2 to 20 | 4 to 20 | 1.45/1.42 | −63.6/−62.1 |
| Example 3 | Toner 3 | 2 to 20 | 6 to 18 | 1.45/1.42 | −64.6/−55.6 |
| Example 4 | Toner 4 | 2 to 20 | 8 to 16 | 1.45/1.39 | −60.3/−52.3 |
| Example 5 | Toner 5 | 2 to 20 | 8 to 16 | 1.46/1.39 | −59.6/−50.3 |
| Example 6 | Toner 6 | 8 to 18 | 10 to 14 | 1.30/1.25 | −46.5/−33.8 |
| Example 7 | Toner 7 | 8 to 18 | 8 to 14 | 1.35/1.26 | −47.5/−40.7 |
| Example 8 | Toner 8 | 2 to 20 | 8 to 16 | 1.40/1.32 | −55.6/−50.2 |
| Example 9 | Toner 9 | 2 to 20 | 4 to 20 | 1.43/1.40 | −63.4/−61.5 |
| Example 10 | Toner 10 | 2 to 20 | 4 to 20 | 1.45/1.43 | −64.2/−63.2 |
| Example 11 | Toner 11 | 2 to 18 | 4 to 16 | 1.29/1.25 | −40.6/−31.3 |
| Example 12 | Toner 12 | 4 to 20 | 6 to 18 | 1.35/1.31 | −60.3/−56.3 |
| Example 13 | Toner 13 | 2 to 20 | 4 to 20 | 1.48/1.46 | −63.9/−60.8 |
| Example 14 | Toner 14 | 2 to 20 | 4 to 20 | 1.50/1.50 | −64.1/−60.6 |
| Example 15 | Toner 15 | 4 to 20 | 4 to 20 | 1.50/1.50 | −63.7/−62.0 |
| Example 16 | Toner 16 | 4 to 20 | 8 to 18 | 1.50/1.35 | −64.2/−60.5 |
| Example 17 | Toner 17 | 4 to 14 | 6 to 12 | 1.40/1.35 | −60.5/−51.2 |
| Example 18 | Toner 18 | 2 to 20 | 4 to 20 | 1.45/1.43 | −63.5/−60.1 |
| Example 19 | Toner 19 | 4 to 20 | 4 to 20 | 1.50/1.48 | −63.8/−60.8 |
| Example 20 | Toner 20 | 2 to 20 | 4 to 20 | 1.50/1.47 | −65.3/−63.2 |
| Example 21 | Toner 21 | 2 to 20 | 4 to 20 | 1.50/1.49 | −64.2/−61.3 |
| Example 22 | Toner 22 | 4 to 20 | 4 to 20 | 1.48/1.48 | −63.5/−61.6 |
| Example 23 | Toner 23 | 4 to 20 | 4 to 20 | 1.42/1.38 | −65.7/−63.6 |
| Example 24 | Toner 24 | 4 to 14 | 6 to 12 | 1.38/1.31 | −54.3/−50.2 |
| Example 25 | Toner 25 | 6 to 14 | 8 to 12 | 1.29/1.21 | −46.3/−42.6 |
| Example 26 | Toner 26 | 8 to 16 | 10 to 14 | 1.28/1.20 | −36.8/−32.1 |
| Example 27 | Toner 27 | 2 to 20 | 4 to 20 | 1.45/1.45 | −65.9/−64.2 |
| Example 28 | Toner 28 | 2 to 20 | 4 to 20 | 1.50/1.50 | −64.2/−63.1 |
| Example 29 | Toner 29 | 6 to 18 | 8 to 16 | 1.45/1.29 | −63.8/−50.6 |
| Example 30 | Toner 30 | 8 to 16 | 10 to 14 | 1.43/1.25 | −56.3/−48.9 |
| Example 31 | Toner 31 | 8 to 18 | 10 to 14 | 1.35/1.28 | −51.6/−46.2 |

TABLE 5-continued

| Example | Toner | Transfer latitude (μA): Initial | Transfer latitude (μA): After endurance | Image density: Initial/after endurance | Charge quantity (mC/kg): Initial/after endurance |
|---|---|---|---|---|---|
| Example 32 | Toner 32 | 2 to 20 | 4 to 20 | 1.50/1.49 | −63.2/−61.0 |
| Example 33 | Toner 33 | 2 to 20 | 4 to 20 | 1.50/1.50 | −64.5/−62.7 |
| Example 34 | Toner 34 | 8 to 18 | 10 to 14 | 1.40/1.28 | −65.8/−48.7 |
| Comparative Example 1 | Toner 35 | 8 to 12 | 10 to 12 | 1.29/1.19 | −60.3/−38.4 |
| Comparative Example 2 | Toner 36 | 10 to 18 | 10 to 12 | 1.35/1.28 | −41.3/−32.1 |
| Comparative Example 3 | Toner 37 | 10 to 12 | None | 1.19/1.11 | −33.2/−28.5 |
| Comparative Example 4 | Toner 38 | 4 to 20 | None | 1.45/1.19 | −68.4/−42.1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-079249, filed Apr. 8, 2015, which is hereby incorporated by reference herein in its entirety.

What is claimed is:

1. A toner, comprising:

a toner particle including a surface layer derived from a resin particle, the resin particle containing a resin having an ionic functional group and an acid dissociation constant pKa of 6.0 to 9.0, the surface layer further comprising an organosilicon polymer having a partial structure represented by formula (1):

$$R^0—SiO_{3/2} \quad (1)$$

wherein $R^0$ represents an alkyl group having 1 to 6 carbon atoms, or a phenyl group, and a ratio of a peak area for the partial structure represented by formula (1) to a total peak area for the organosilicon polymer is 5.0% or more in a $^{29}$Si-NMR measurement of a tetrahydrofuran-insoluble matter of the toner particle.

2. A toner according to claim 1, wherein a ratio of a silicon atom density dSi with respect to a total of 100.0 atomic % of a carbon atom density dC, an oxygen atom density dO, and the silicon atom density dSi on the surface of the toner particle is 1.0 to 28.6 atomic % in X-ray photoelectron spectroscopic analysis of a surface of the toner particle.

3. A toner according to claim 1, wherein when 16 straight lines that cross a cross-section of the toner particle are drawn so as to pass through a midpoint of a long axis L that is a maximum diameter of the cross-section of the toner particle and to form an equal crossing angle at the midpoint (crossing angle: 11.25°), forming 32 line segments from the midpoint to a surface of the toner particle, in X-ray photoelectron spectroscopic analysis of a surface of the toner particle the surface layer on the 32 line segments has an average thickness Dav. of 5.0 nm or more.

4. A toner according to claim 3, wherein a ratio of a number of the line segments having thicknesses of 2.5 nm or less of the surface layer is 20.0% or less.

5. A toner according to claim 1, wherein the resin having an ionic functional group has a pKa of 7.0 to 8.5.

6. A toner according to claim 1, wherein $R^0$ represents a methyl group or an ethyl group.

7. A toner according to claim 1, wherein the resin having an ionic functional group is a polymer A having a monovalent group represented by formula (2):

(2)

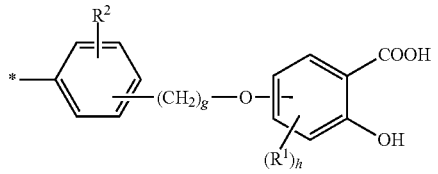

where $R^1$ represents a hydroxy group, a carboxy group, an alkyl group having 1 to 18 carbon atoms, or an alkoxy group having 1 to 18 carbon atoms, $R^2$ represents a hydrogen atom, a hydroxy group, an alkyl group having 1 to 18 carbon atoms, or an alkoxy group having 1 to 18 carbon atoms, g represents an integer of 1 to 3, h represents an integer of 0 to 3, and when h represents 2 or 3, h $R^1$'s may be the same or different, and

* represents a binding site in a main chain structure of the polymer A.

8. A toner according to claim 1, wherein the resin particle containing the resin having an ionic functional group has a median diameter (D50) on a volume basis of 5 to 200 nm.

* * * * *